US011431107B2

(12) United States Patent
Park et al.

(10) Patent No.: US 11,431,107 B2
(45) Date of Patent: Aug. 30, 2022

(54) CHIP ANTENNA MODULE AND METHOD OF MANUFACTURING CHIP ANTENNA MODULE

(71) Applicant: Samsung Electro-Mechanics Co., Ltd., Suwon-si (KR)

(72) Inventors: Ju Hyoung Park, Suwon-si (KR); Sung Yong An, Suwon-si (KR); Myeong Woo Han, Suwon-si (KR); Sung Nam Cho, Suwon-si (KR); Jae Yeong Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/739,177

(22) Filed: Jan. 10, 2020

(65) Prior Publication Data

US 2020/0328530 A1 Oct. 15, 2020

(30) Foreign Application Priority Data

Apr. 11, 2019 (KR) ..... 10-2019-0042634
Aug. 14, 2019 (KR) ..... 10-2019-0099400

(51) Int. Cl.
*H01Q 1/22* (2006.01)
*H01Q 9/04* (2006.01)
*H01Q 21/06* (2006.01)

(52) U.S. Cl.
CPC ..... *H01Q 21/065* (2013.01)

(58) Field of Classification Search
CPC ..... H01Q 1/2283; H01Q 1/243; H01Q 1/36; H01Q 1/38; H01Q 1/48; H01Q 21/065;
(Continued)

(56) References Cited

U.S. PATENT DOCUMENTS 5,003,318 A * 3/1991 Berneking ..... H01Q 9/0414 343/700 MS
5,153,600 A 10/1992 Metzler et al.
(Continued)

FOREIGN PATENT DOCUMENTS

JP 5-211406 A 8/1993
JP 9-232857 A 9/1997
(Continued)

OTHER PUBLICATIONS

Korean Office Action dated Jun. 10, 2020 in the corresponding Korean Patent Application No. 10-2019-0099400 (6 pages in English, 5 pages in Korean).
(Continued)

*Primary Examiner* — Thai Pham
(74) *Attorney, Agent, or Firm* — NSIP Law

(57) ABSTRACT

A chip antenna module includes: a first dielectric layer; a first feed via extending through the first dielectric layer; a second feed via extending through the first dielectric layer; a first patch antenna pattern disposed on an upper surface of the first dielectric layer, electrically connected to the first feed via, and having a through-hole through which the second feed via passes; a second patch antenna pattern disposed above the first patch antenna pattern and electrically connected to the second feed via; and a second dielectric layer and a third dielectric layer, respectively located vertically between the first patch antenna pattern and the second patch antenna pattern, and having different dielectric constants that form a first dielectric constant boundary surface between the first and second patch antenna patterns.

29 Claims, 29 Drawing Sheets

(58) Field of Classification Search
CPC ..... H01Q 21/28; H01Q 9/04; H01Q 9/0414; H01Q 9/045
See application file for complete search history.

(56) References Cited

U.S. PATENT DOCUMENTS

| | | | | |
|---|---|---|---|---|
| 8,749,434 | B2 * | 6/2014 | Han | H01Q 13/18 343/700 MS |
| 2009/0207080 | A1 | 8/2009 | Floyd et al. | |
| 2012/0280860 | A1 * | 11/2012 | Kamgaing | H01Q 3/30 342/368 |
| 2012/0287019 | A1 * | 11/2012 | Sudo | H01Q 9/045 343/904 |
| 2016/0056544 | A1 * | 2/2016 | Garcia | H01Q 1/38 343/725 |
| 2018/0159203 | A1 * | 6/2018 | Baks | H01Q 1/2283 |
| 2018/0219281 | A1 * | 8/2018 | Sudo | H01Q 1/405 |
| 2019/0036232 | A1 | 1/2019 | Kang et al. | |
| 2019/0319364 | A1 | 10/2019 | Yang et al. | |
| 2019/0348749 | A1 | 11/2019 | Thai et al. | |
| 2020/0220270 | A1 * | 7/2020 | Onaka | H01Q 9/045 |

FOREIGN PATENT DOCUMENTS

| | | | | |
|---|---|---|---|---|
| JP | 09232857 | A | * | 9/1997 |
| JP | 5413467 | B2 | | 2/2014 |
| JP | 2018-82224 | A | | 5/2018 |
| JP | 2018-125704 | A | | 8/2018 |
| KR | 10-1164618 | B1 | | 7/2012 |
| KR | 10-2019-0013383 | A | | 2/2019 |

OTHER PUBLICATIONS

Korean Office Action dated Jan. 9, 2020 in the related Korean Patent Application No. 10-2019-0069808 (6 pages in English, 5 pages in Korean).
Office Action dated Aug. 30, 2021 in counterpart U.S. Appl. No. 16/661,241 (15 Pages in English).

* cited by examiner

CHIP ANTENNA MODULE AND METHOD OF MANUFACTURING CHIP ANTENNA MODULE

CROSS-REFERENCE TO RELATED APPLICATIONS

This application claims the benefit under 35 U.S.C. § 119(a) of Korean Patent Application Nos. 10-2019-0042634 and 10-2019-0099400 filed on Apr. 11, 2019 and Aug. 14, 2019, respectively, in the Korean Intellectual Property Office, the entire disclosures of which are incorporated herein by reference for all purposes.

BACKGROUND

1. Field

The following description relates to a chip antenna module.

2. Description of Related Art

Data traffic for mobile communications is increasing rapidly every year. Technological development is underway to support the transmission of such rapidly increased data in real time in wireless networks. For example, the contents of internet of things (IoT) based data, augmented reality (AR), virtual reality (VR), live VR/AR combined with SNS, autonomous navigation, applications such as Sync View (real-time video transmissions of users using ultra-small cameras), and the like may require communications (e.g., 5G communications, mmWave communications, etc.) supporting the transmission and reception of large amounts of data.

Recently, millimeter wave (mmWave) communications, including $5^{th}$ generation (5G) communications, have been researched, and research into the commercialization/standardization of an antenna module for smoothly realizing such communications is progressing.

Since radio frequency (RF) signals in high frequency bands (e.g., 24 GHz, 28 GHz, 36 GHz, 39 GHz, 60 GHz, etc.) are easily absorbed and lost in the course of the transmission thereof, the quality of communications may be dramatically reduced. Therefore, antennas for communications in high frequency bands may require different approaches from those of conventional antenna technology, and a separate approach may require further special technologies, such as implementing separate power amplifiers for securing antenna gain, integrating an antenna and radio frequency integrated circuit (RFIC), securing effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna module includes: a first dielectric layer; a first feed via extending through the first dielectric layer; a second feed via extending through the first dielectric layer; a first patch antenna pattern disposed on an upper surface of the first dielectric layer, electrically connected to the first feed via, and having a through-hole through which the second feed via passes; a second patch antenna pattern disposed above the first patch antenna pattern and electrically connected to the second feed via; and a second dielectric layer and a third dielectric layer, respectively located vertically between the first patch antenna pattern and the second patch antenna pattern, and having different dielectric constants that form a first dielectric constant boundary surface between the first and second patch antenna patterns.

The second dielectric layer may be disposed below the third dielectric layer. A dielectric constant of the second dielectric layer may be less than a dielectric constant of the third dielectric layer and a dielectric constant of the first dielectric layer.

The chip antenna module may further include a fourth dielectric layer disposed above the second patch antenna pattern. A dielectric constant of a region corresponding to the fourth dielectric layer, among regions overlapping the second patch antenna pattern, may be less than the dielectric constant of the third dielectric layer.

The chip antenna module may further include a fifth dielectric layer disposed above the fourth dielectric layer. A thickness of the fourth dielectric layer may be less than a thickness of the second dielectric layer.

The chip antenna module may further include fourth and fifth dielectric layers respectively located above the second patch antenna pattern, and having different dielectric constants that form a second dielectric constant boundary surface above the second patch antenna pattern.

The chip antenna module may further include a coupling patch pattern disposed on an upper surface of the fifth dielectric layer. The fourth dielectric layer may be disposed below the fifth dielectric layer. A dielectric constant of the fourth dielectric layer may be less than a dielectric constant of the fifth dielectric layer and a dielectric constant of an uppermost positioned one of the second and third dielectric layers.

A dielectric constant of an uppermost positioned one of the second and third dielectric layers may be less than a dielectric constant of lowermost positioned one of the second and third dielectric layers. A dielectric constant of a lowermost positioned one of the fourth and fifth dielectric layers may be greater than a dielectric constant of an uppermost positioned one of the fourth and fifth dielectric layers, and may be greater than the dielectric constant of the uppermost positioned one of the second and third dielectric layers.

The chip antenna module may further include: a fifth dielectric layer disposed above the second patch antenna pattern; and a coupling patch pattern disposed on an upper surface of the fifth dielectric layer.

The coupling patch pattern may have a hole.

The second dielectric layer may include a polymer, and the third dielectric layer may include a ceramic.

The chip antenna module may further include shielding vias electrically connected to the first patch antenna pattern, extending through the first dielectric layer, and surrounding the second feed via.

A size of the second patch antenna pattern may be smaller than a size of the first patch antenna pattern. A portion of the first feed via may be disposed to not overlap the second patch antenna pattern.

The chip antenna module may further include a solder layer disposed on a lower surface of the first dielectric layer.

The chip antenna module may further include pads disposed on a lower surface of the first dielectric layer along a peripheral portion of the first dielectric layer.

A portable electronic device may include the chip antenna module.

In another general aspect, a chip antenna module may include: a first dielectric layer; a first feed via extending through the first dielectric layer; a second feed via extending through the first dielectric layer; a first patch antenna pattern disposed on an upper surface of the first dielectric layer, electrically connected to the first feed via, and having a through-hole through which the second feed via passes; a second patch antenna pattern disposed above the first patch antenna pattern and electrically connected to the second feed via; and a fourth dielectric layer and a fifth dielectric layer respectively located above the second patch antenna pattern, and having different dielectric constants that form a second dielectric constant boundary surface above the second patch antenna pattern.

The chip antenna module may further include shielding vias electrically connected to the first patch antenna pattern, extending through the first dielectric layer, and surrounding the second feed via.

A size of the second patch antenna pattern may be smaller than a size of the first patch antenna pattern. A portion of the first feed via may be disposed to not overlap the second patch antenna pattern.

The chip antenna module may further include a coupling patch pattern disposed on an upper surface of the fifth dielectric layer.

A size of the coupling patch pattern may be smaller than a size of the second patch antenna pattern.

The coupling patch pattern may have a hole.

The chip antenna module may further include a coupling patch pattern disposed on an upper surface of the fifth dielectric layer. The fourth dielectric layer may be disposed below the fifth dielectric layer. A dielectric constant of the fourth dielectric layer may be less than a dielectric constant of the fifth dielectric layer and a dielectric constant of the first dielectric layer.

The chip antenna module may further include a solder layer disposed on a lower surface of the first dielectric layer.

The chip antenna module may further include pads disposed on the first dielectric layer along a peripheral portion of the first dielectric layer.

The chip antenna module may further include a second dielectric layer and a third dielectric layer respectively located vertically between the first patch antenna pattern and the second patch antenna pattern.

A portable electronic device may include the chip antenna module.

In another general aspect, a method of manufacturing a chip antenna module includes: disposing a first surface of a second dielectric layer on a first surface of a third dielectric layer; disposing a second patch antenna pattern on a second surface of the third dielectric layer, opposite the first surface of the third dielectric layer; disposing a first patch antenna pattern on a first surface of a first dielectric layer; forming a first feed via extending through the first dielectric layer; electrically connecting the first feed via to the first patch antenna pattern; disposing a second surface of the second dielectric layer, opposite the first surface of the second dielectric layer, on the first surface of the first dielectric layer; forming a second feed via extending through the first dielectric layer, a through-hole in the first patch antenna pattern, the second dielectric layer, and the third dielectric layer; and electrically connecting the second feed via to the second patch antenna pattern. A dielectric constant of the second dielectric layer is different from a dielectric constant of the third dielectric layer.

The method may further include: disposing a first surface of a fourth dielectric layer on the second surface of the third dielectric layer; and disposing a first surface of a fifth dielectric layer on a second surface of the fourth dielectric layer, opposite the first surface of the fourth dielectric layer. A dielectric constant of the fourth dielectric layer may be different from a dielectric constant of the fifth dielectric layer.

The method may further include disposing a coupling patch pattern on a second surface of the fifth dielectric layer, opposite the first surface of the fifth dielectric layer.

The method may further include disposing a solder layer on a second surface of a first dielectric layer, opposite the first surface of the first dielectric layer.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
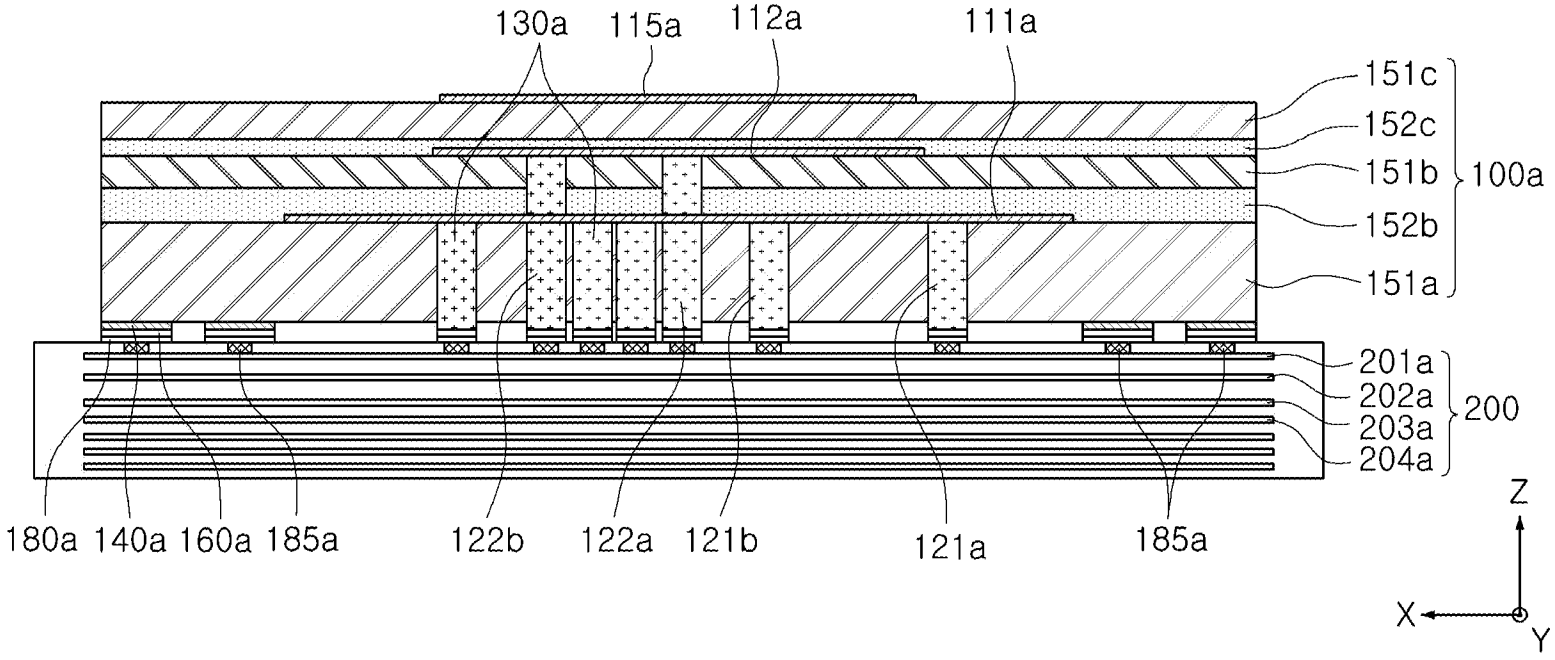
FIG. 1A is a side view illustrating a chip antenna module, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

According to an aspect of the following disclosure, a chip antenna module is capable of improving antenna performance and/or being miniaturized, while enabling transmission and reception in a plurality of different frequency bands.

Figure 2A:
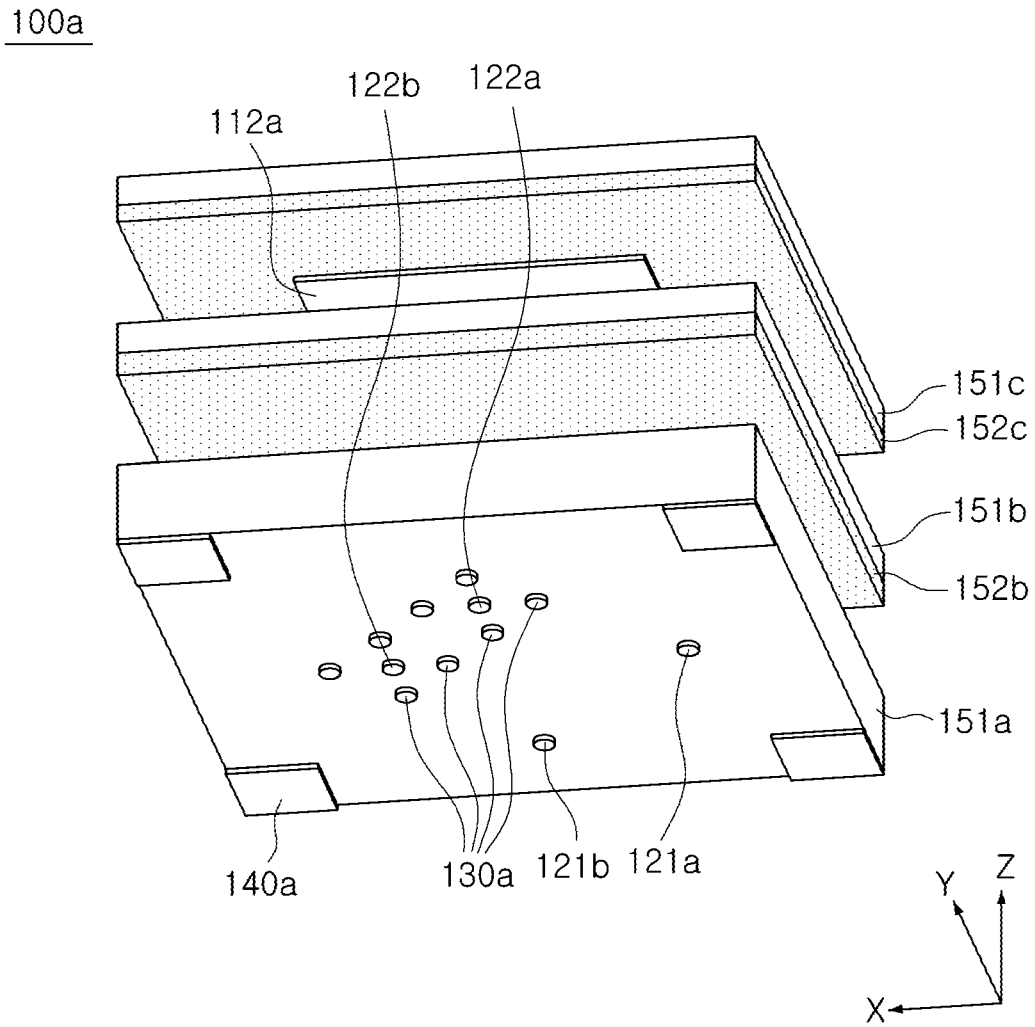
FIGS. 2A and 2B are perspective views illustrating a chip antenna module, according to an embodiment.
Figure 2B:
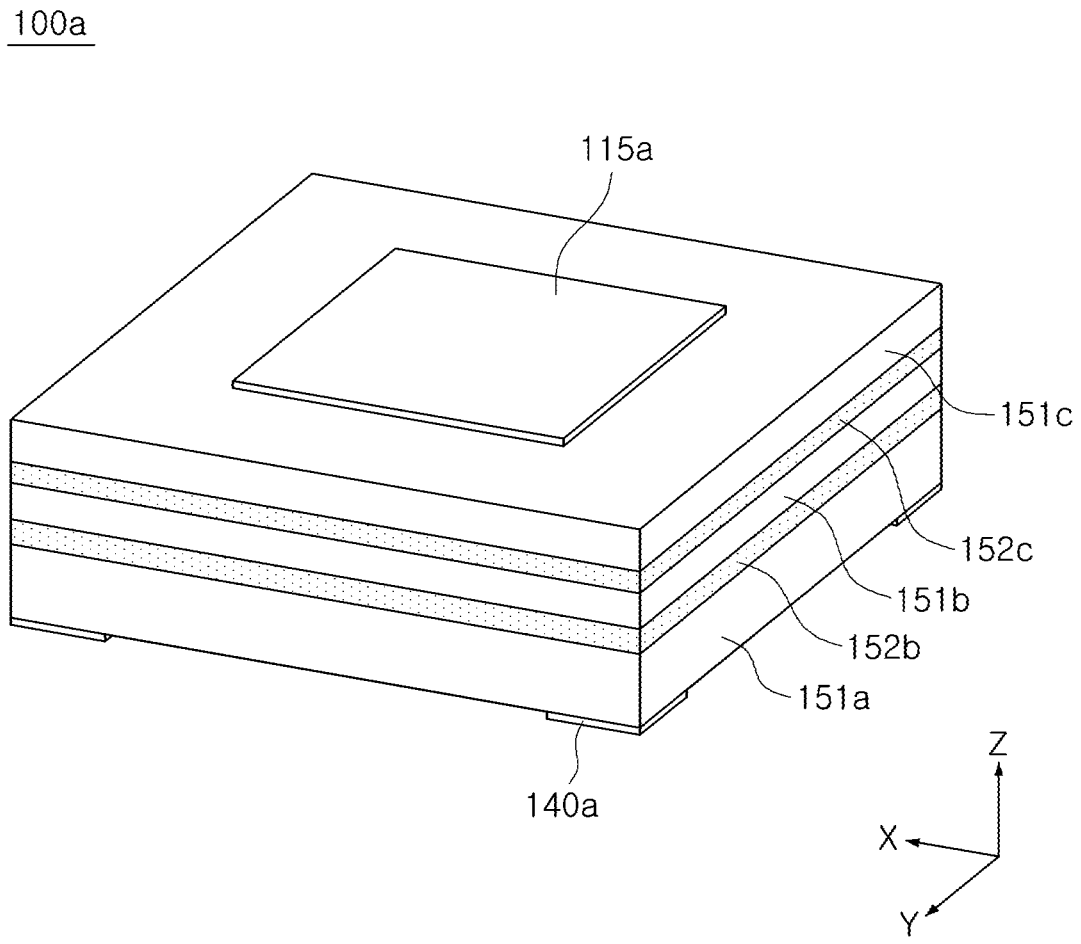
Figure 3:
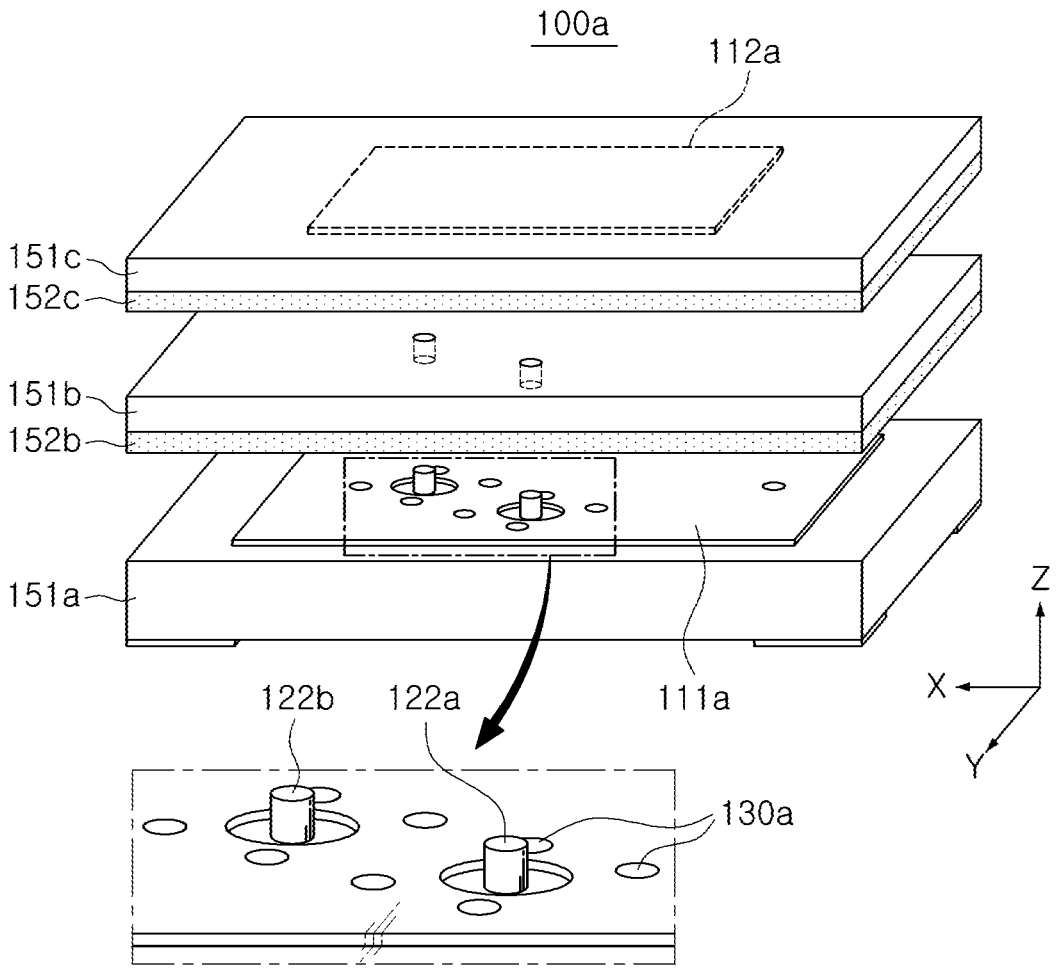
FIG. 3 is a perspective view illustrating shield vias disposed in a chip antenna module, according to an embodiment.

FIG. 1A is a side view illustrating a chip antenna module 100*a*, according to an embodiment. FIGS. 2A and 2B are perspective views illustrating the chip antenna module 100*a*, according to an embodiment. FIG. 3 is a perspective view illustrating shield vias 130*a* disposed in the chip antenna module 100*a*, according to an embodiment.

Referring to FIGS. 1A, 2A, 2B, and 3, the chip antenna module 100*a* may include a first patch antenna pattern 111*a* and a second patch antenna pattern 112*a* to enable transmission/reception in a plurality of different frequency bands, and may further include a coupling patch pattern 115*a* to widen a frequency bandwidth corresponding to the second patch antenna pattern 112*a*. The coupling patch pattern 115*a* may be omitted, depending on bandwidth design conditions.

In addition, the chip antenna module 100*a* may include first feed vias 121*a* and 121*b* and second feed vias 122*a* and 122*b*, and may be disposed on a first ground plane 201*a*.

The first patch antenna pattern 111*a* may be electrically connected to one ends of the first feed vias 121*a* and 121*b*. Therefore, the first patch antenna pattern 111*a* may receive a first radio frequency (RF) signal of a first frequency band (for example, 28 GHz) from the first feed vias 121*a* and 121*b*, and may transmit the first RF signal externally, or the first patch antenna pattern 111*a* may receive the first RF signal from an external source, and may transmit the first RF signal to the first feed vias 121*a* and 121*b*.

The second patch antenna pattern 112*a* may be electrically connected to first ends of the second feed vias 122*a* and 122*b*. Therefore, the second patch antenna pattern 112*a* may receive a second radio frequency (RF) signal of a second frequency band (for example, 39 GHz) from the second feed vias 122*a* and 122*b*, and may transmit the second RF signal externally, or may receive the second RF signal from an external source, and may transmit the second RF signal to the second feed vias 122*a* and 122*b*.

The first and second patch antenna patterns 111*a* and 112*a* may resonate with respect to the first and second frequency bands, respectively, to intensively receive energy corresponding to the first and second signals and radiate the energy externally.

Since the first ground plane 201*a* may reflect the first and second RF signals radiated toward the first ground plane 201*a*, among the first and second RF signals emitted by the first and second patch antenna patterns 111*a* and 112*a*, radiation patterns of the first and second patch antenna patterns 111*a* and 112*a* may be concentrated in a specific direction (e.g., the Z direction). Therefore, gains of the first and second patch antenna patterns 111*a* and 112*a* may be improved.

Resonance of the first and second patch antenna patterns 111*a* and 112*a* may occur based on a resonant frequency according to a combination of inductance and capacitance corresponding to structures of the first and second patch antenna patterns 111*a* and 112*a* and their surrounding structures.

Sizes (e.g., areas) of upper and/or lower surfaces of each of the first and second patch antenna patterns 111*a* and 112*a* may affect the resonant frequency. For example, sizes of the upper and/or lower surfaces of the first and second patch antenna patterns 111*a* and 112*a* may be dependent on first and second wavelengths, corresponding to the first and second frequencies, respectively. When the first frequency is less than the second frequency, the first patch antenna pattern 111*a* may be larger than the second patch antenna pattern 112*a*.

In addition, at least portions of the first and second patch antenna patterns 111*a* and 112*a* may overlap each other in a vertical direction (for example, the Z direction). Therefore, since a size of the chip antenna module 100*a* in a horizontal direction (e.g., the X direction and/or the Y direction) may be greatly reduced, the chip antenna module 100*a* may be easily downsized overall.

The first and second feed vias 121*a*, 121*b*, 122*a*, and 122*b* may be arranged to pass through at least one through-hole of the first ground plane 201*a*. Therefore, the first ends of the first and second feed vias 121*a*, 121*b*, 122*a*, and 122*b* may be located above the first ground plane 201*a*, and the second ends of the first and second feed vias 121*a*, 121*b*, 122*a*, and 122*b* may be located below the first ground plane 201*a*. In this case, the other ends of the first and second feed vias 121*a*, 121*b*, 122*a*, and 122*b* may be electrically connected to an integrated circuit (IC) mounted on a component mounting surface, to transmit the first and second RF signals to the IC or receive them from the IC. Electromagnetic isolation between the first and second patch antenna patterns 111*a* and 112*a* and the IC may be improved by the first ground plane 201*a*.

For example, the first feed vias 121*a* and 121*b* may be a 1-1 feed via and a 1-2 feed via, respectively, through which a 1-1 RF signal and a 1-2 RF signal, which are polarized differently with respect to each other, pass, respectively. The second feed vias 122*a* and 122*b* may be a 2-1 feed via and a 2-2 feed via, respectively, through which a 2-1 RF signal and a 2-2 RF signal, which are polarized differently with respect each other, pass, respectively.

For example, each of the first and second patch antenna patterns 111*a* and 112*a* may transmit and receive a plurality of RF signals, and the plurality of RF signals may be a plurality of carrier signals carrying different data. A data transmission/reception rate of each of first and second patch antenna patterns 111*a* and 112*a* may be improved by two times in accordance with transmission and reception of the plurality of RF signals.

For example, the 1-1 RF signal and the 1-2 RF signal may have different phases (e.g., phase difference of 90 degrees or 180 degrees) to reduce interference with each other, and the 2-1 RF signal and the 2-2 RF signal may have different phases (e.g., a phase difference of 90 degrees or 180 degrees) to reduce interference with each other.

For example, the 1-1 RF signal and the 2-1 RF signal may form an electric field and a magnetic field in the X direction and the Y direction, perpendicular to each other and perpendicular to a propagation direction (e.g., the Z direction), respectively, and the 1-2 RF signal and the 2-2 RF signal may form a magnetic field and an electric field in the X direction and the Y direction, respectively, to implement polarization between the RF signals. Surface currents corresponding to the 1-1 RF signal and the 2-1 RF signal, and surface currents corresponding to the 1-2 RF signal and the 2-2 RF signal, in the first and second patch antenna patterns 111*a* and 112*a*, may flow perpendicular to each other.

Therefore, the 1-1 feed via and the 2-1 feed via may be connected adjacent to an edge of the first and second patch antenna patterns 111*a* and 112*a* in one direction (e.g., the X direction), and the 1-2 feed via and the 2-2 feed via may be connected adjacent to an edge of the first and second patch antenna patterns 111*a* and 112*a* in the other direction (e.g., the Y direction). However, specific connection points of the 1-1, 2-1, 1-2, and 2-2 feed vias may vary depending on a design.

Energy loss of the first and second RF signals in the chip antenna module 100*a* may decrease, as an electrical distance from the first and second patch antenna patterns 111*a* and 112*a* to an IC becomes shorter. Since a distance between the first and second patch antenna patterns 111*a* and 112*a* and the IC in the vertical direction (e.g., the Z direction) may be relatively short, the electrical distance between the first and second patch antenna patterns 111*a* and 112*a* and the IC may be easily reduced due to the first and second feed vias 121*a*, 121*b*, 122*a*, and 122*b*.

When at least portions of the first and second patch antenna patterns 111*a* and 112*a* overlap each other, the second feed vias 122*a* and 122*b* may be arranged to pass through the first patch antenna pattern 111*a* to be electrically connected to the second patch antenna pattern 112*a*.

Therefore, transmission energy loss of the first and second RF signals in the chip antenna module 100*a* may be reduced, and connection points of the first and second feed vias 121*a*, 121*b*, 122*a*, and 122*b* in the first and second patch antenna patterns 111*a* and 112*a* may be designed more freely.

The connection points of the first and second feed vias 121*a*, 121*b*, 122*a*, and 122*b* may affect transmission line impedance related to the first and second RF signals. As the transmission line impedance is matched adjacent to a specific impedance (for example, 50 ohms), reflection in the process of providing the first and second RF signals may be reduced. Therefore, when the degree of freedom in design of the connection points of the first and second feed vias 121*a*, 121*b*, 122*a*, and 122*b* is relatively high, the gains of the first and second patch antenna patterns 111*a* and 112*a* may be more easily improved.

As a distance in the first patch antenna pattern 111*a* between a second point through which the second feed vias 122*a* and 122*b* pass and a first point to which the first feed vias 121*a* and 121*b* are electrically connected increases, a first surface current starting at the first point of the first patch antenna pattern 111*a* may be more strongly suppressed by the second point.

For example, as a distance in the first patch antenna pattern 111*a* between the first point and the second point increases, the gain of the first patch antenna pattern 111*a* may be further improved.

When the distance between the first point and the second point is too long, a point in the second patch antenna pattern 112*a* to which the second feed vias 122*a* and 122*b* are electrically connected may be closer to a center of the second patch antenna pattern 112*a*.

As the point to which the second feed vias 122*a* and 122*b* are electrically connected becomes closer to the center of the second patch antenna pattern 112*a*, connection impedance between the second patch antenna pattern 112*a* and the second feed vias 122*a* and 122*b* may be more difficult to get close to specific impedance (e.g., 50 ohms).

The chip antenna module 100*a* may provide an electromagnetic environment in which a size of the second patch antenna pattern 112*a* is reduced, without substantially changing a resonant frequency of the second patch antenna pattern 112*a*.

When the size of the second patch antenna pattern 112*a* is reduced, without substantially changing a resonant frequency of the second patch antenna pattern 112*a*, and there is no substantial change in position of the second feed vias 122*a* and 122*b*, the point in the second patch antenna pattern 112*a* to which the second feed vias 122*a* and 122*b* are connected may be closer to the edge of the second patch antenna pattern 112*a*.

Therefore, it may be relatively easy to make the connection impedance between the second patch antenna pattern 112*a* and the second feed vias 122*a* and 122*b* closer to specific impedance (for example, 50 ohms), and the gain of the second patch antenna pattern 112*a* may be further improved.

For example, the chip antenna module 100*a* may extend the distance in the first patch antenna pattern 111*a* between the first point and the second point, to improve the gain of the first patch antenna pattern 111*a*, and may easily match the connection impedance in the second patch antenna pattern 112*a* between the second feed vias 122*a* and 122*b* to specific impedance (for example, 50 ohms), to improve the gain of the second patch antenna pattern 112*a*.

The electromagnetic environment in which the size of the second patch antenna pattern 112*a* is reduced, without substantially changing the resonant frequency of the second patch antenna pattern 112*a* may be implemented by an electromagnetic boundary surface around the second patch antenna pattern 112*a*. The electromagnetic boundary surface may be a dielectric constant boundary surface on which both sides of the boundary surface are composed of media having different dielectric constants.

Since the both sides of the dielectric constant boundary surface are composed of media having different dielectric constants, an inclination angle of an oblique incident wave inclined with respect to the dielectric constant boundary surface and an inclination angle of a radio wave passing through the dielectric constant boundary surface may be different from each other.

For example, when the second RF signal remotely received from the outside is propagated obliquely from a third dielectric layer 151*b* to a second dielectric layer 152*b*, the second RF signal may be propagated at a more inclined angle on a first dielectric constant boundary surface in the horizontal direction. Thereafter, the second RF signal may be reflected by the first patch antenna pattern 111*a*. Thereafter, when the second RF signal is propagated obliquely from the second dielectric layer 152*b* to the third dielectric layer 151*b*, the second RF signal may be propagated at a more inclined angle on the first dielectric constant boundary surface in the vertical direction.

In this example, a distance in the horizontal direction in which the second RF signal is propagated in the second dielectric layer 152*b* may be longer than a case in which only the third dielectric layer 151*b* constitutes a space between the first and second patch antenna patterns 111*a* and 112*a*. For example, the second RF signal remotely transmitted and received by the second patch antenna pattern 112*a* may be propagated in the chip antenna module 100*a* in a direction closer to the horizontal direction, without dispersion of the propagation direction outside the chip antenna module 100*a* in the horizontal direction.

Therefore, the second patch antenna pattern 112*a* having a dielectric constant boundary surface formed at an upper side or a lower side thereof may operate electromagnetically as if the dielectric constant boundary surface has a relatively larger size in the horizontal direction than a case in which the dielectric constant boundary surface is not formed.

Therefore, the second patch antenna pattern 112*a* may have a relatively reduced size, without substantially changing the resonant frequency.

In addition, since the first patch antenna pattern 111*a* may significantly avoid the second patch antenna pattern 112*a* electromagnetically to form a radiation pattern, the gain of the first patch antenna pattern 111*a* may be improved.

Figure 1B:
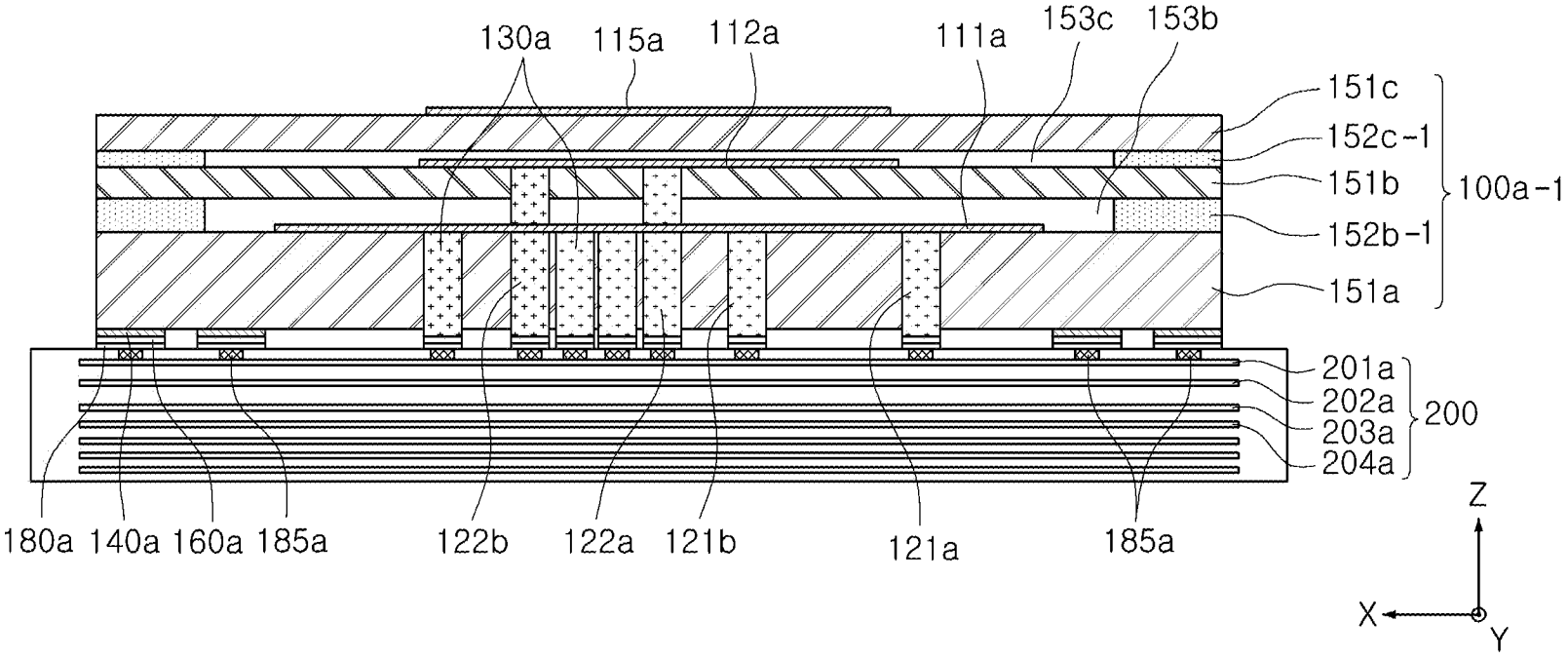
FIG. 1B is a side view illustrating a chip antenna module including air cavities, according to an embodiment.
Figure 1C:
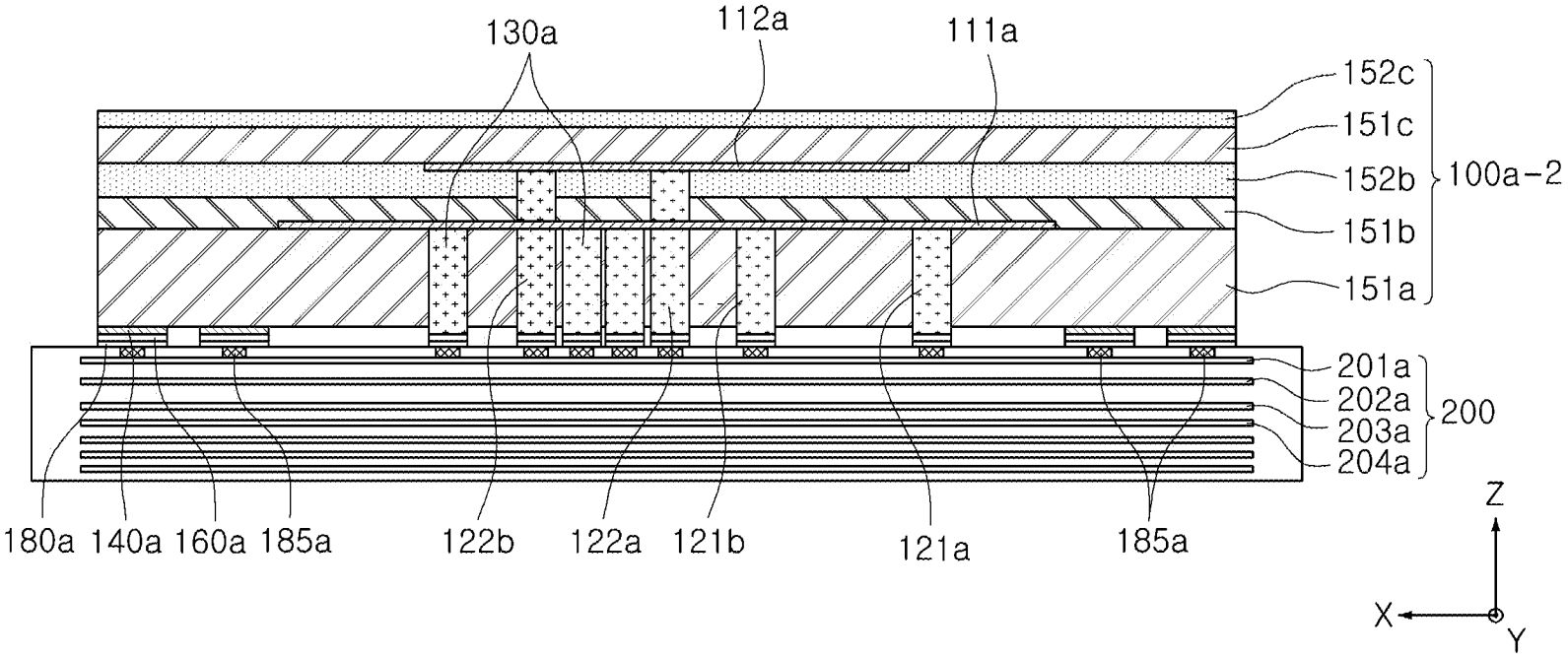
FIG. 1C is a side view illustrating various vertical relationships of dielectric layers of a chip antenna module, according to an embodiment.
Figure 1D:
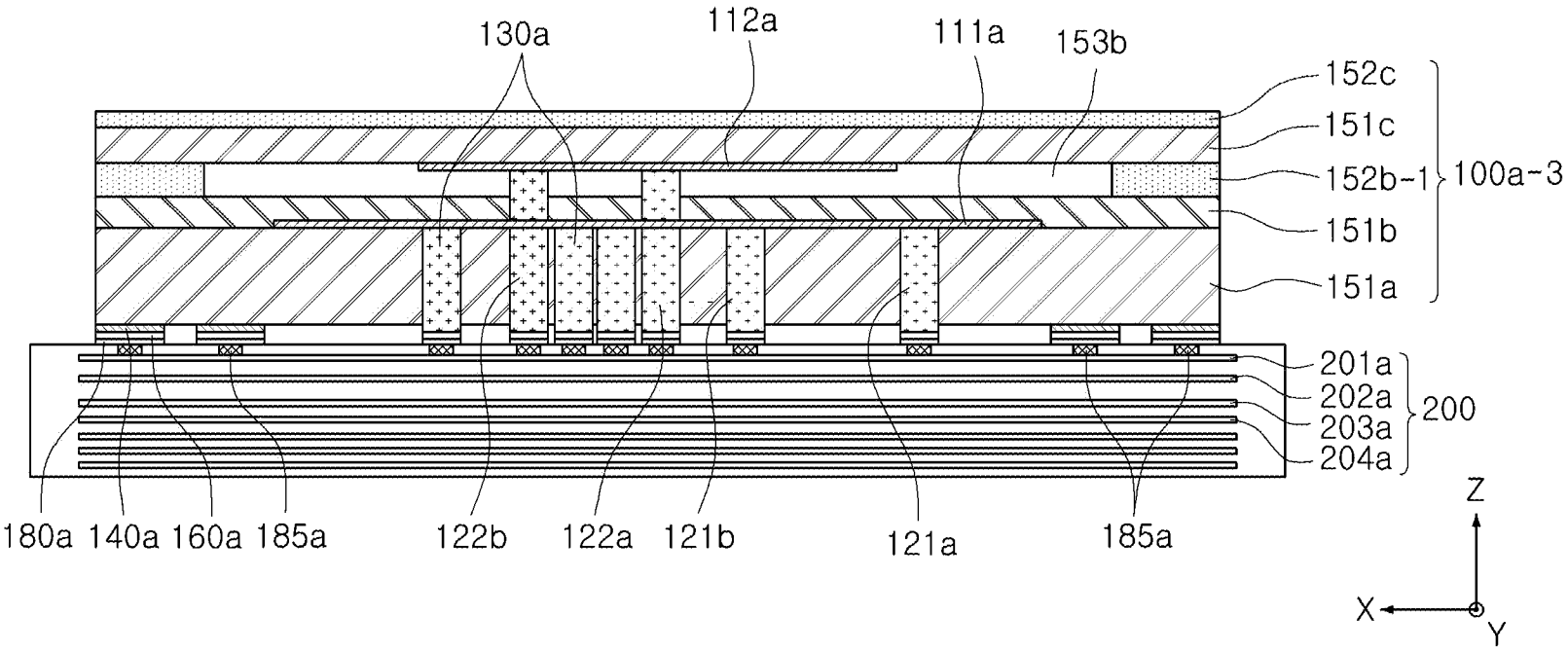
FIG. 1D is a side view illustrating a chip antenna module similar to the chip antenna module illustrated in FIG. 1C, but including an air cavity.
Figure 1E:
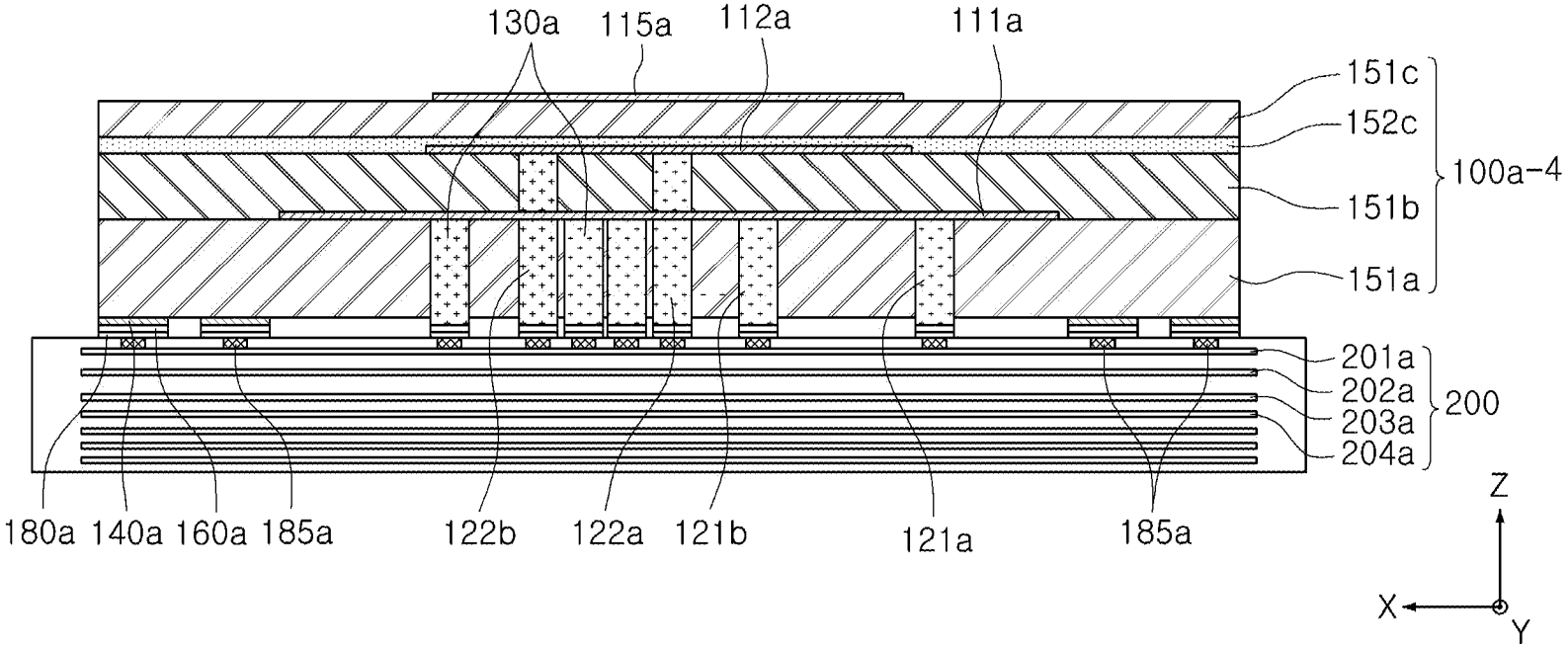
FIG. 1E is a side view illustrating a chip antenna module including a single dielectric layer between first and second patch antenna patterns, according to an embodiment.
Figure 1F:
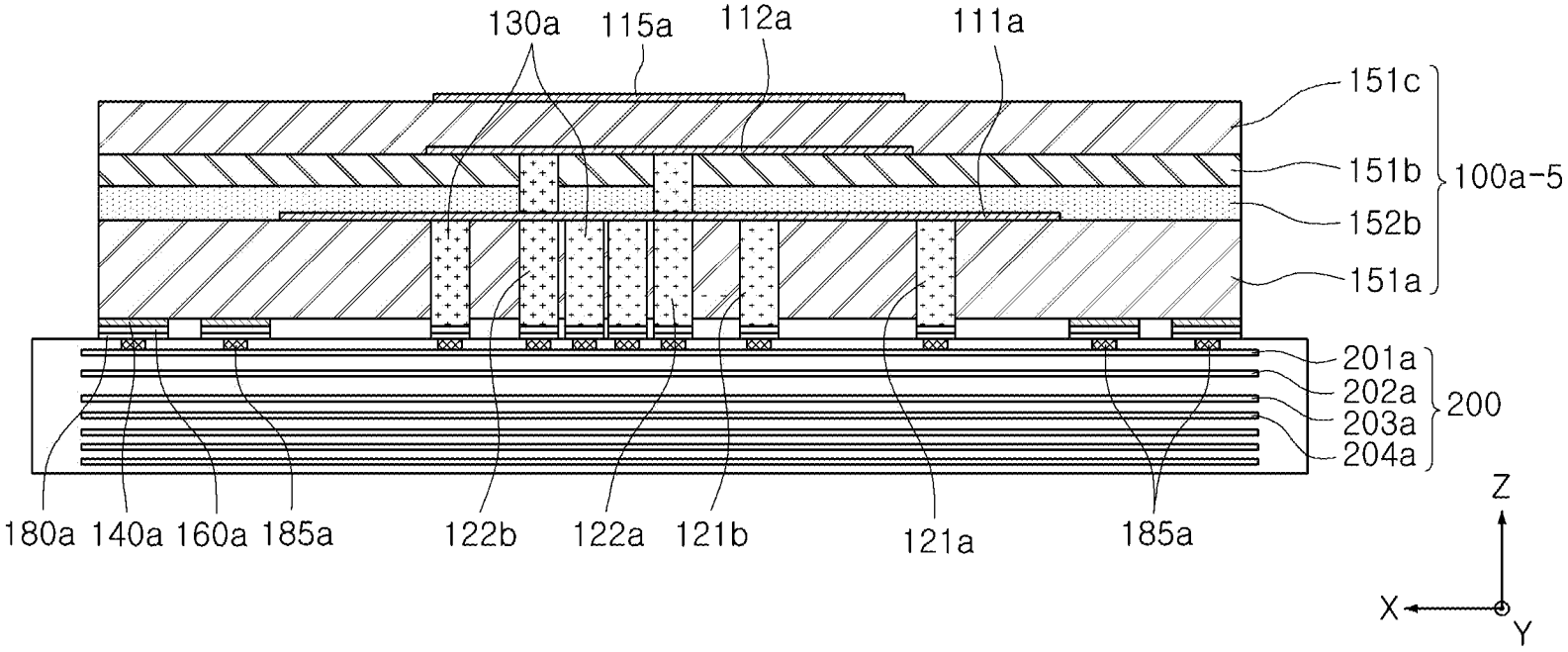
FIG. 1F is a side view illustrating a chip antenna module including a single dielectric layer between a second patch antenna pattern and a coupling patch pattern, according to an embodiment.

FIG. 1B is a side view illustrating a chip antenna module 100*a*-1 including air cavities 153*b* and 153*c*, according to an embodiment. FIG. 10 is a side view illustrating various vertical relationships of a plurality of dielectric layers 151*a*, 151*b*, 151*c*, and 152*b* of a chip antenna module 100*a*-2, according to an embodiment. FIG. 1D is a side view illustrating a chip antenna module 100*a*-3 that is similar to the chip antenna module 100*a*-2 illustrated in FIG. 10, but includes the air cavity 153*b*. FIG. 1E is a side view illustrating a chip antenna module 100*a*-4 including a single dielectric layer 151*b* between first and second patch antenna patterns 111*a* and 112*a*, according to an embodiment. FIG. 1F is a side view illustrating a chip antenna module 100*a*-5 including a single dielectric layer 151*c* between the second patch antenna pattern 112*a* and the coupling patch pattern 115*a*, according to an embodiment of the present disclosure.

Referring to FIGS. 1A, 1B, 10, 1D, and 1F, the chip antenna modules 100*a*, 100*a*-1, 100*a*-2, 100*a*-3, and 100*a*-5 may include second and third dielectric layers 152*b*/152*b*-1 and 151*b* located at different vertical levels between first and second patch antenna patterns 111*a* and 112*a*, respectively, surrounding the feed vias 122*a* and 122*b*, and forming a first dielectric constant boundary surface having different dielectric constants between the first and second patch antenna patterns 111*a* and 112*a*. In the chip antenna modules 100*a*, 100*a*-2, 100*a*-4, and 100*a*-5 of FIGS. 1A, 10, 1E, and 1F, respectively, the first dielectric constant boundary surface is formed at an interface between the second and third dielectric layers 152*b* and 151*b*. In the chip antenna modules 100*a*-1 and 100*a*-3 of FIGS. 1B and 1D, respectively, the first dielectric constant boundary surface is formed at an interface between the second and third dielectric layers 152*b*-1 and 151*b* and an interface between the cavity 153*b* and third dielectric layer 151*b*.

Referring to FIGS. 1A, 1B, 10, 1D, and 1E, the chip antenna modules 100*a*, 100*a*-1, 100*a*-2, 100*a*-3, and 100*a*-4 may include fourth and fifth dielectric layers 152*c*/152*c*-1 and 151*c* located at different vertical levels above the second patch antenna pattern 112*a*, and forming a second dielectric constant boundary surface having different dielectric constants above the second patch antenna pattern 112*a*. In the chip antenna modules 100*a*, 100*a*-2, 100*a*-3, and 100*a*-4 of FIGS. 1A, 10, 1D, and 1E, respectively, the second dielectric constant boundary surface is formed at an interface between the fourth and fifth dielectric layers 152*c* and 151*c*. In the chip antenna module 100*a*-1 of FIG. 1B, the second dielectric constant boundary surface is formed at an interface between the fourth and fifth dielectric layers 152*c*-1 and 151*c*, and at an interface between the cavity 153*c* and the fifth dielectric layer 151*c*.

Referring to FIGS. 1A, 1B, 10, and 1D, the chip antenna modules 100*a*, 100*a*-1, 100*a*-2, and 100*a*-3 may have both first and second dielectric constant boundary surfaces.

Referring to FIGS. 1E and 1F, the chip antenna modules 100*a*-4 and 100*a*-5 may have only one of first and second dielectric constant boundary surfaces, depending on a design.

Referring to FIGS. 1A, 10, 1E, and 1F, second and third dielectric layers 152*b* and 151*b* may have different dielectric constants, and fourth and fifth dielectric layers 152*c* and 151*c* may have different dielectric constants.

For example, the first, third, and fifth dielectric layers 151*a*, 151*b*, and 151*c* may be formed of a material having relatively high dielectric constant, such as a ceramic-based material, such as a low temperature co-fired ceramic (LTCC), or a glass-based material, and may be configured to have relatively high dielectric constant and relatively high durability by further containing any one or any combination of any two or more of magnesium (Mg), silicon (Si), aluminum (Al), calcium (Ca), and titanium (Ti). For example, the first, third, and fifth dielectric layers 151*a*, 151*b*, and 151*c* may include any one or any combination of any two or more of $Mg_2SiO_4$, $MgAlO_4$, and $CaTiO_3$.

For example, the second and fourth dielectric layers 152*b* and 152*c* may be configured to have a dielectric constant lower than a dielectric constant of an insulating layer of a connection member 200. For example, the second and fourth dielectric layers 152*b* and 152*c* may be made of a polymer, but are not limited to a polymer. For example, the second and fourth dielectric layers 152*b* and 152*c* may be made of a ceramic configured to have a dielectric constant lower than that of the third and fifth dielectric layers 151*b* and 151*c*, may be made of a material having a high plasticity such as a liquid crystal polymer (LCP) or polyimide, may be made of an epoxy resin having high strength or high adhesion, may be made of a material having a high durability, such as Teflon, or may be made of a material having a high compatibility with the connection member 200, such as prepreg.

For example, a thickness of the fourth dielectric layer 152*c* may be less than a thickness of the second dielectric layer 152*b*. When the first patch antenna pattern 111*a* is larger than the second patch antenna pattern 112*a*, a spacing distance between the first dielectric constant boundary surface of the second and third dielectric layers 152*b* and 151*b* and the first patch antenna pattern 111*a* may be longer than a spacing distance between the second dielectric constant boundary surface of the fourth and fifth dielectric layers 152*c* and 151*c* and the second patch antenna pattern 112*a*. Therefore, since the first patch antenna pattern 111*a* may significantly avoid the second patch antenna pattern 112*a* electromagnetically to form a radiation pattern, the gain of the first patch antenna pattern 111*a* may be further improved.

A structure in which the thickness of the fourth dielectric layer 152*c* is less than the thickness of the second dielectric layer 152*b* may be a structure further electromagnetically suitable for a structure in which the size of the first patch antenna pattern 111*a* is larger than the size of the second patch antenna pattern 112*a*.

Therefore, when the thickness of the fourth dielectric layer 152*c* is less than the thickness of the second dielectric layer 152*b*, the overall gains of the first and second patch antenna patterns 111*a* and 112*a* may be improved.

Referring to FIGS. 1B and 1D, the second and/or fourth dielectric layers 152*b*-1 and/or 152*c*-1 may not have a lower dielectric constant than the third and/or fifth dielectric layers 151*b* and/or 151*c*, and may provide an air cavity 153*b* and/or 153*c*, to form the first and/or second dielectric constant boundary surfaces.

Referring to FIG. 1B, the chip antenna module 100*a*-1 may have the air cavities 153*b* and 153*c*.

Referring to FIG. 1D, the chip antenna module 100*a*-3 may have the single air cavity 153*b*.

Referring to FIGS. 1B and 1D, the air cavities 153*b* and/or 153*c* may be formed by being surrounded by second and/or fourth dielectric layers 152*b*-1 and/or 152*c*-1.

The air cavities 153*b* and 153*c* may have a dielectric constant of 1, and, therefore, may have a dielectric constant less than a dielectric constant of the second and fourth dielectric layers 152*b*-1 and 152*c*-1. Therefore, since a difference in dielectric constant between media at the both sides of the first and/or second dielectric constant boundary surfaces formed by the air cavity 153*b*/153*c* and the third and fifth dielectric layers 151*b* and 151*c* may become larger, the first and/or second dielectric constant boundary surfaces may provide an electromagnetic environment that may facilitate a reduction in the size of the second patch antenna pattern 112*a*.

Since air in the air cavity 153*b*/153*c* may contact the second patch antenna pattern 112*a*, at least a portion of the second patch antenna pattern 112*a* may include a plating layer. Therefore, since a chemical reaction between the second patch antenna pattern 112*a* and the air may be further reduced, the durability of the second patch antenna pattern 112*a* may be further improved. For example, the plating layer may be formed of a metal material such as copper, nickel, tin, silver, gold, or palladium, but is not limited to these examples.

Referring to FIG. 10, the second dielectric layer 152*b* may be disposed above the third dielectric layer 151*b*, depending on a design, and the fourth dielectric layer 152*c* may be disposed above the fifth dielectric layer 151*c*, depending on a design. In the example of FIG. 10, the fourth dielectric layer 152*c* may be omitted, depending on a design.

For example, an upper dielectric constant of the first dielectric constant boundary surface between the first and second patch antenna patterns 111*a* and 112*a* may be less than a lower dielectric constant of the first dielectric constant boundary surface, and a lower dielectric constant of the second dielectric constant boundary surface, which is disposed higher than the second patch antenna pattern 112*a*, may be greater than an upper dielectric constant of the second dielectric constant boundary surface, and may be greater than the upper dielectric constant of the first dielectric constant boundary surface.

In the example of FIG. 10, a lower surface of the fifth dielectric layer 151*c* may provide an arrangement space of the second patch antenna pattern 112*a*, a lower surface of the third dielectric layer 151*b* may provide an arrangement space of the first patch antenna pattern 111*a*, and the coupling patch pattern 115*a* may be omitted.

Referring to FIGS. 1A, 1B, 10, 1D, 1E, and 1F, the chip antenna modules 100*a*, 100*a*-1, 100*a*-2, 100*a*-3, 100*a*-4, and 100*a*-5 may be mounted on a connection member 200. For example, the connection member 200 may have a stacked structure including at least a portion of the first ground plane 201*a*, a wiring ground plane 202*a*, a second ground plane 203*a*, and an IC ground plane 204*a*, and may be implemented as a printed circuit board (PCB).

The chip antenna module 100*a*/100*a*-1/100*a*-2/100*a*-3/100*a*-4/100*a*-5 and the connection member 200 may be manufactured separately from each other, and, after the manufacturing, may be physically coupled to each other.

Therefore, the first, second, third, fourth, and fifth dielectric layers 151*a*, 152*b*/152*b*-1, 151*b*, 152*c*/152*c*-1, and 151*c* may be more easily be configured to have characteristics of the insulating layer of the connection member 200 (e.g., dielectric constant, dielectric tangent, durability, etc.). Therefore, the chip antenna module 100*a*/100*a*-1/100*a*-2/100*a*-3/100*a*-4/100*a*-5 may easily be configured to have improved antenna characteristics (e.g., gain, bandwidth, directivity, etc.), compared to conventional antenna modules of a similar size, and the connection member 200 may further improve feed lines, wiring performance of feed vias (e.g., warpage strength relative to stacking number, low dielectric constant, etc.).

A lower surface of the first dielectric layer 151*a* may provide an arrangement space of a solder layer 140*a*. The solder layer 140*a* may be mounted on an upper surface of the connection member 200, and may be physically coupled to the connection member 200.

For example, a chip antenna module 100*a*/100*a*-1/100*a*-2/100*a*-3/100*a*-4/100*a*-5 may be arranged such that the solder layer 140*a* overlaps a second solder layer 180*a* disposed on the upper surface of the connection member 200. The second solder layer 180*a* may be connected to a peripheral via 185*a* of the connection member 200, to have a relatively strong bonding force with respect to the connection member 200. For example, the peripheral via 185*a* may connect the second solder layer 180*a* to the first ground plane 201*a*.

The solder layer 140*a* and the second solder layer 180*a* may be bonded by a relatively low melting point material-based solder paste such as tin (Sn). The solder paste may be inserted between the solder layer 140*a* and the second solder layer 180*a* at a temperature higher than a melting point of the solder paste, and may be configured as an electrical connection structure 160*a* as the temperature decreases. For example, the electrical connection structure 160*a* may electrically connect the solder layer 140*a* and the second solder layer 180*a*.

For example, in order to improve the bonding efficiency between the solder layer 140*a* and the second solder layer 180*a*, surfaces of the solder layer 140*a* and the second solder layer 180*a* may have a stacked structure of a nickel plating layer and a tin plating layer, but are not limited to this example. For example, at least a portion of the solder layer 140*a* and the second solder layer 180*a* may be formed by a plating process, and the first dielectric layer 151*a* may be configured to have characteristics suitable for plating process of the solder layer 140*a* (e.g., reliability with regard to high temperature).

In addition, the lower surface of the first dielectric layer 151*a* may provide a lead-out space for the first and second feed vias 121*a*, 121*b*, 122*a*, and 122*b* and the shielding vias 130*a*.

Therefore, the electrical connection structure 160*a* having a relatively low melting point or a relatively large horizontal width may be connected to a lower end of each of the first and second feed vias 121*a*, 121*b*, 122*a*, and 122*b* and the shielding vias 130*a*. For example, the electrical connection structure may be formed of one or more of solder balls, pins, lands, and pads, and may have a shape similar to the solder layer 140*a*, depending on a design.

An upper surface of the first dielectric layer 151*a* may provide an arrangement space of the first patch antenna pattern 111*a*.

The lower surface of the third dielectric layer 151*b* may provide an arrangement space of the second patch antenna pattern 112*a*.

An upper surface of the third dielectric layer 151*b* may provide an arrangement space of the coupling patch pattern 115*a*. Since the coupling patch pattern 115*a* and the fourth and fifth dielectric layers 152*c*/152*c*-1 and 151*c* may be omitted, depending on a design, the upper surface of the third dielectric layer 151*b* may be covered by an encapsulant, depending on a design.

Depending on a design, the coupling patch pattern 115*a* may be electrically connected to the first and second feed vias 121*a*, 121*b*, 122*a*, and 122*b* or may be connected to an additional feed via, and may have a resonant frequency different from the resonant frequencies of the first and second patch antenna patterns 111*a* and 112*a*. For example, the resonant frequency of the coupling patch pattern 115*a* may be close to 60 GHz, and the chip antenna module 100*a*/100*a*-1/100*a*-4/100*a*-5 may use the first and second patch antenna patterns 111*a* and 112*a* and the coupling patch pattern 115*a* to provide three bands of remote transmission/reception means.

RF signals transmitted and received by a chip antenna module according to the disclosure herein may have wavelengths based on the overall dielectric constants of the first, second, third, fourth, and fifth dielectric layers 151*a*, 152*b*/152*b*-1, 151*b*, 152*c*152*c*-1/, and 151*c*, when the RF signals pass through the first, second, third, fourth, and fifth dielectric layers 151*a*, 152*b*/152*b*-1, 151*b*, 152*c*/152*c*-1, and 151*c*. For example, effective wavelengths of the RF signals in the chip antenna module 100*a*/100*a*-1/100*a*-2/100*a*-3/100*a*-4/100*a*-5 may be shortened according to relatively high dielectric constants of the first dielectric layer 151*a*, the third dielectric layer 151*b*, and the fifth dielectric layer 151*c*. Since the overall size of the chip antenna module 100*a*/100*a*-1/100*a*-2/100*a*-3/100*a*-4/100*a*-5 has a relatively high correlation with a length of each of the effective wavelengths of the RF signals, the chip antenna module 100*a* may include the first dielectric layer 151*a*, the third dielectric layer 151*b*, and/or the fifth dielectric layer 151*c*, having a relatively high dielectric constant, to have a relatively reduced size, without substantially deteriorating antenna performance.

The overall size of the chip antenna module 100*a*/100*a*-1/100*a*-2/100*a*-3/100*a*-4/100*a*-5 may correspond to the number of arrangements of the chip antenna module 100*a*/100*a*-1/100*a*-2/100*a*-3/100*a*-4/100*a*-5 per unit size of the first ground plane 201*a*. For example, the overall gains and/or directivity of the plurality of chip antenna modules 100*a*/100*a*-1/100*a*-2/100*a*-3/100*a*-4/100*a*-5 may be easily improved, as the size of the chip antenna modules 100*a*/100*a*-1/100*a*-2/100*a*-3/100*a*-4/100*a*-5 is smaller.

Referring to FIGS. 2A and 3, the chip antenna module 100*a*, according to an embodiment, may further include shielding vias 130*a* surrounding second feed vias 122*a* and 122*b*.

The shielding vias 130*a* may be arranged to electrically connect the first patch antenna pattern 111*a* and the first ground plane 201*a* to each other. Therefore, a first RF signal radiated toward the second feed vias 122*a* and 122*b*, among first RF signals radiated from a first patch antenna pattern 111*a*, may be reflected by the shielding vias 130*a*. Electromagnetic isolation between first and second RF signals may be improved, and a gain of each of first and second patch antenna patterns 111*a* and 112*a* may be improved.

In this example, the number and width of the shielding vias 130*a* are not particularly limited. When a spacing interval between the shield vias 130*a* is shorter than a certain length (e.g., a length dependent on the first wavelength of the first RF signal), the first RF signal may not substantially pass through a space between the shield vias 130*a*. Therefore, the electromagnetic isolation between the first and second RF signals may be further improved.

When the second feed vias 122*a* and 122*b* include a plurality of second feed vias, the plurality of shielding vias 130*a* may be arranged to surround the plurality of second feed vias 122*a* and 122*b*, respectively.

Therefore, since the electromagnetic isolation between the second feed vias 122*a* and 122*b* may be further improved, interference between a 2-1 RF signal and a 2-2 RF signal in the second patch antenna pattern 112*a* may be reduced. Thus, electromagnetic isolation may be further improved, and the overall gain of the second patch antenna pattern 112*a* may be further improved.

First feed vias 121*a* and 121*b* may be located in positions biased in a first direction from a center of the first patch antenna pattern 111*a*, and the second feed vias 122*a* and 122*b* may be located closer to the center of the first patch antenna pattern 111*a*, than to the first feed vias 121*a* and 121*b*.

For example, a size (e.g., area) of the second patch antenna pattern 112*a* may be smaller than a size (e.g., area) of the first patch antenna pattern 111*a*, and the first feed vias 121*a* and 121*b* may be arranged adjacent to an edge of the first patch antenna pattern 111*a* to not overlap the second patch antenna pattern 112*a*.

Since the shielding vias 130*a* may be electrically connected to the first patch antenna pattern 111*a*, a surface current of the first patch antenna pattern 111*a* may flow from a connection point of the first feed vias 121*a* and 121*b* to a connection point of the shielding vias 130*a*.

Since a first dielectric constant boundary surface between the first and second patch antenna patterns 111*a* and 112*a* or a second dielectric constant boundary surface above the second patch antenna pattern 112*a* may allow reduction in the size of the second patch antenna pattern 112*a*, through-holes in the first patch antenna pattern 111*a* through which the second feed vias 122*a* and 122*b* pass may be positioned closer to the center of the first patch antenna pattern 111*a*.

Since the shielding vias 130*a* may be arranged to surround the through-holes, an electrical distance between the first feed vias 121*a* and 121*b* and the shielding vias 130*a* may become longer. Influence of the surface current of the first patch antenna pattern 111*a* by the shielding vias 130*a* may become smaller, as the electrical distance increases.

Therefore, since the surface current of the first patch antenna pattern 111*a* may be further concentrated at the edge of the first patch antenna pattern 111*a*, the RF signal of the first patch antenna pattern 111*a* may easily avoid the second patch antenna pattern 112*a*, to be remotely transmitted and received in the Z direction. For example, a phenomenon in which the second patch antenna pattern 112*a* interferes with radiation of the first patch antenna pattern 111*a* may be further reduced, and the gain of the first patch antenna pattern 111*a* may be further improved.

FIGS. 4A to 4D are plan views illustrating various forms of a solder layer in a chip antenna module, according to embodiments.

Figure 4A:
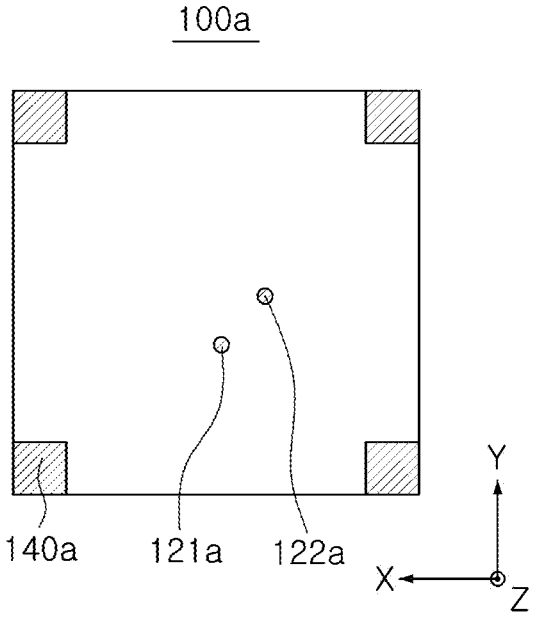
FIGS. 4A to 4D are plan views illustrating various forms of a solder layer in a chip antenna module, according to an embodiment.

Referring to FIG. 4A, the solder layer 140*a* of the chip antenna module 100*a* may include quadrangular shaped portions disposed at corner regions of the chip antenna module 100*a*. In other embodiments, the solder layer 140*a* of the chip antenna module 100*a* may include polygonal shaped portions or circular shaped portions.

Figure 4B:
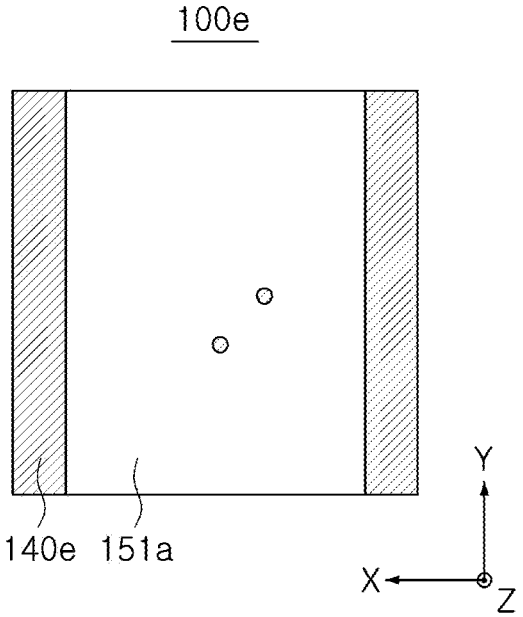

Referring to FIG. 4B, a solder layer 140*e* of a chip antenna module 100*e* may have a straight bar shape.

Figure 4C:
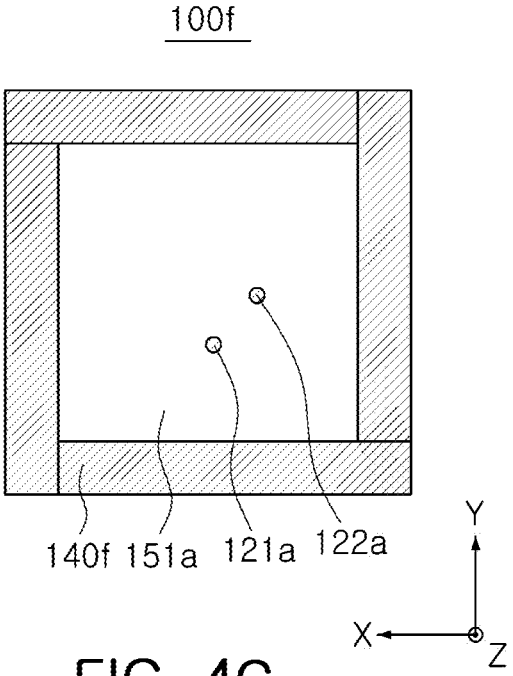

Referring to FIG. 4C, a solder layer 140*f* of a chip antenna module 100*f* may have a shape of a guide ring surrounding an outer edge of the chip antenna module 100*f*.

Bonding force of the solder layer 140*a*/140*e*/140*f* to a connection member (e.g., the connection member 200) may be stronger as a size of the solder layer 140*a* increases. Therefore, the shape of the solder layers 140*a*, 140*e*, and 140*f* may be determined based on characteristics of the chip antenna modules 100*a*, 100*e*, and 100*f* (e.g., the total number of arrays, the total number of patch antenna patterns, the total number of vias, etc.).

Figure 4D:
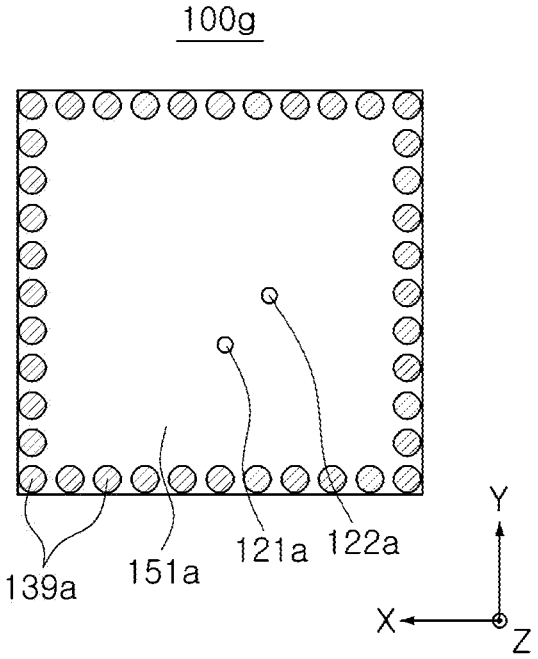

Referring to FIG. 4D, a solder layer of a chip antenna module 100*g* may include peripheral pads 139*a*. Although FIG. 4D illustrates that shapes of the peripheral pads 139*a* are circular, the shapes of the peripheral pads 139*a* may be polygonal, depending on a design.

The peripheral pads 139*a* may be electrically connected to a ground plane of a connection member (e.g., the connection member 200).

Since the peripheral pads 139*a* may provide an array reference when the chip antenna module 100*g* is mounted on the connection member 200, accuracy of arrangement of the chip antenna module 100*g* and antenna adjacent thereto may be improved.

In addition, since the peripheral pads 139*a* may provide a physical bonding force to the connection member 200 when the chip antenna module 100*g* is mounted on the connection member 200, physical stability of the chip antenna module 100*g* may be improved.

Figure 4E:
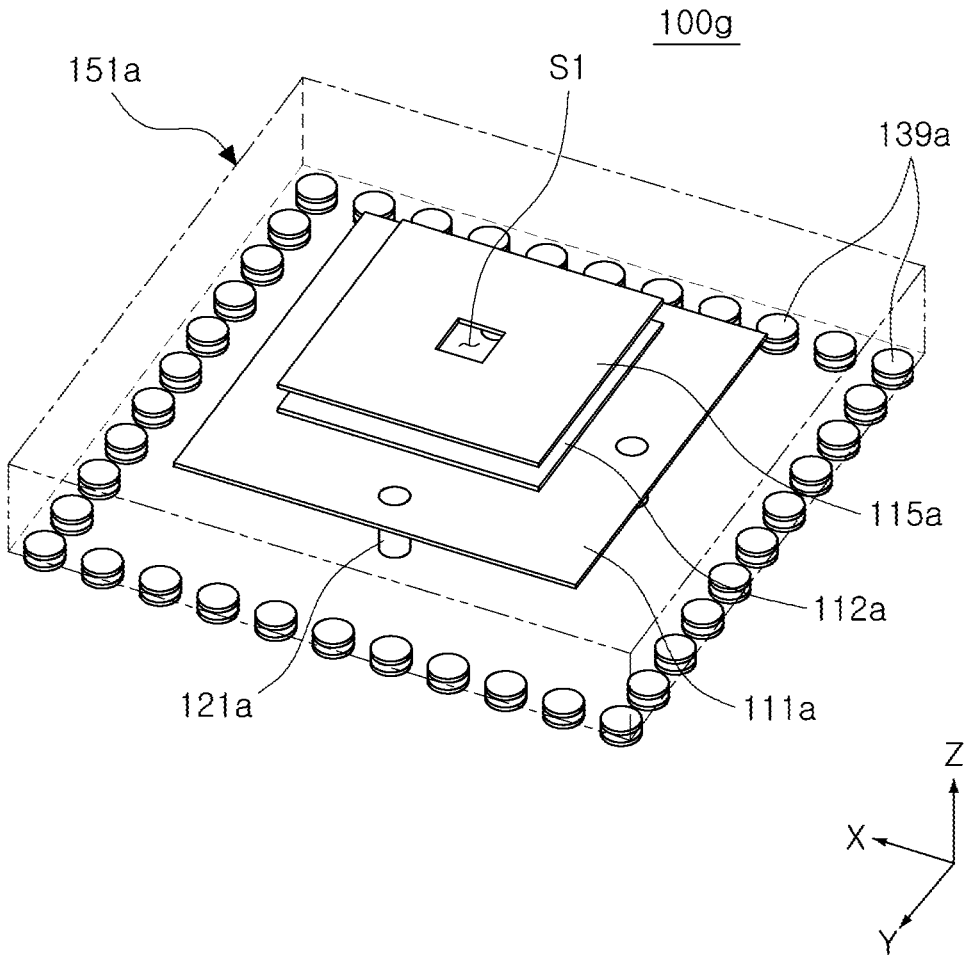
FIG. 4E is a perspective view illustrating holes of a coupling patch pattern in a chip antenna module, according to an embodiment.

FIG. 4E is a perspective view illustrating holes of the coupling patch pattern 115*a* in the chip antenna module 100*g*, according to an embodiment.

Referring to FIG. 4E, the coupling patch pattern 115*a* of the chip antenna module 100*g* may have a hole S1. Although FIG. 4E illustrates that a shape of the hole S1 is a quadrangular shape, the shape of the hole S1 may be a polygonal shape or a circular shape, rather than a quadrangular shape, depending on a design.

The coupling patch pattern 115*a* may generate a surface current flowing through the coupling patch pattern 115*a*, as the coupling patch pattern 115*a* is electromagnetically coupled to a second patch antenna pattern 112*a*. Since the surface current flows by bypassing the hole S1 of the coupling patch pattern 115*a*, the surface current may flow in a longer electrical length than a physical length of the coupling patch pattern 115*a*.

The electrical length may correspond to resonant frequency of the coupling patch pattern 115*a*, and may widen a bandwidth of the second patch antenna pattern 112*a*. Therefore, the resonant frequency may correspond to frequency of the second RF signal transmitted and received by the second patch antenna pattern 112*a*.

In a case in which the resonant frequency is fixed corresponding to the frequency of the second RF signal, the coupling patch pattern 115*a* may increase the electrical length in terms of surface current since the coupling patch pattern 115*a* has the hole S1, and the coupling patch pattern 115*a* may thus be made smaller. For example, the coupling patch pattern 115*a* having the holes S1 may be miniaturized more easily.

Electromagnetic effect of the coupling patch pattern 115*a* on a first patch antenna pattern 111*a* may be smaller, as a size of the coupling patch pattern 115*a* is smaller. Since the coupling patch pattern 115*a* may be a medium of electromagnetic interference between the first and second patch antenna patterns 111*a* and 112*a*, the electromagnetic interference between the first and second patch antenna patterns 111*a* and 112*a* may become smaller, as the coupling patch pattern 115*a* becomes smaller.

Therefore, since the coupling patch pattern 115*a* having the hole S1 is easily miniaturized, the electromagnetic interference between the first and second patch antenna patterns 111*a* and 112*a* may be reduced, and the gains of the first and second patch antenna patterns 111*a* and 112*a* may be improved.

In addition, since a chip antenna module according to the disclosure herein may have a dielectric constant boundary surface between the first and second patch antenna patterns 111*a* and 112*a* according to a configuration of the second and third dielectric layers 152*b*/152*b*-1 and 151*b*, to reduce a size of the second patch antenna pattern 112*a*, the size of the second patch antenna pattern 112*a* and the size of the coupling patch pattern 115*a* may be reduced together.

Since the second patch antenna pattern 112*a* may be disposed between the first patch antenna pattern 111*a* and the coupling patch pattern 115*a*, the coupling patch pattern 115*a* may be prevented from electromagnetically coupling to the first patch antenna pattern 111*a*.

Therefore, when the second patch antenna pattern 112*a* and the coupling patch pattern 115*a* become smaller together, a chip antenna module according to the disclosure herein may improve isolation characteristics due to the coupling of the coupling patch pattern 115*a* to the first patch antenna pattern 111*a*, while improving impedance characteristics due to a connection point of second feed vias 122*a* and 122*b* of the second patch antenna pattern 112*a*.

Figure 4F:
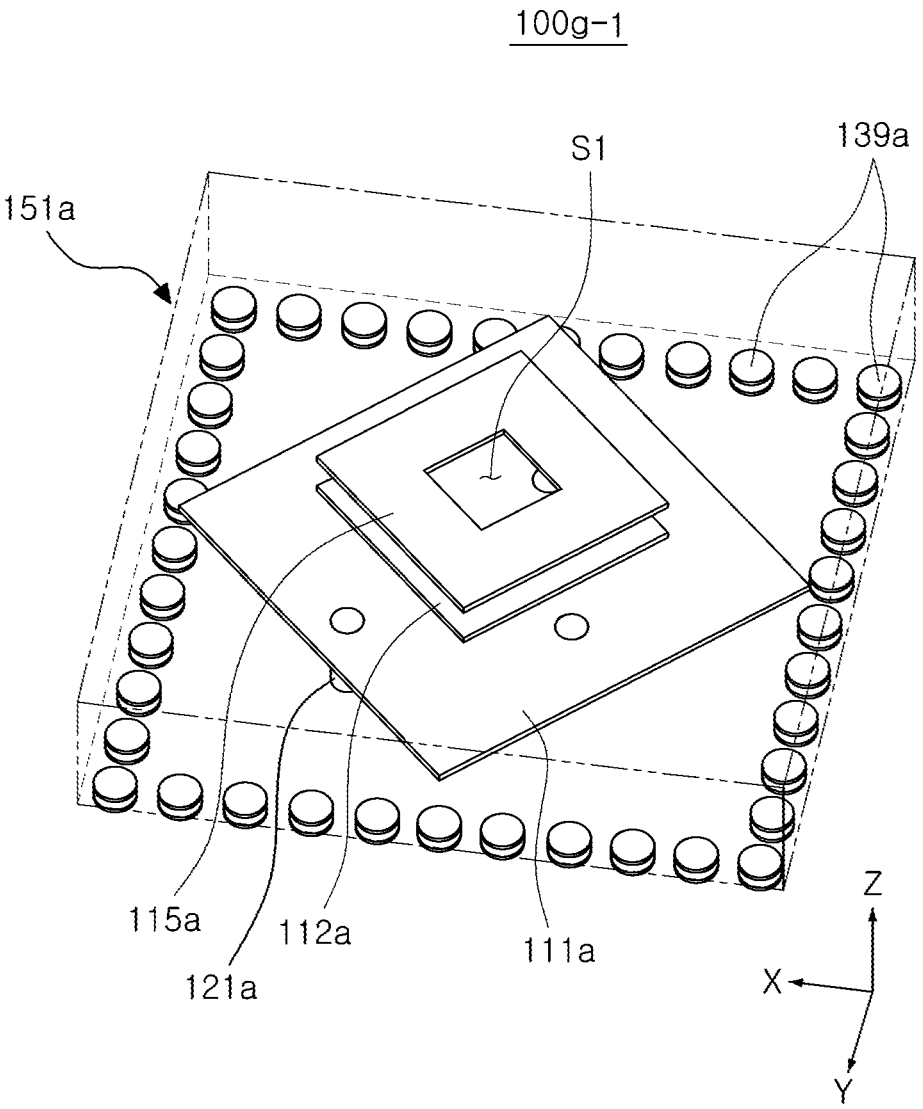
FIG. 4F is a perspective view illustrating an oblique arrangement of a patch antenna pattern with regard to a dielectric layer in a chip antenna module, according to an embodiment.

FIG. 4F is a perspective view illustrating an oblique arrangement of a patch antenna pattern with regard to a dielectric layer in a chip antenna module 100*g*-1, according to an embodiment.

Referring to FIG. 4F, an upper surface of the first dielectric layer 151*a* may have a polygonal shape (e.g., a quadrangular shape), an upper surface of the first or second patch antenna pattern 111*a* or 112*a* may have a polygonal shape (e.g., a quadrangular shape), and one side of the upper surface of the first or second patch antenna pattern 111*a* or 112*a* may be oblique to one side of the upper surface of the first dielectric layer 151*a*.

The first and second patch antenna patterns 111*a* and 112*a* may generate a surface current flowing from one side of the first and second patch antenna patterns 111*a* and 112*a* to the other side, when transmitting and receiving an RF signal. Due to the surface current, an electric field may be formed in the same horizontal direction (e.g. the X direction or the Y direction) as a direction of the surface current, a magnetic field may be formed in a horizontal direction, perpendicular to the direction of the surface current, and the RF signal may be propagated in a vertical direction (e.g., the Z direction).

The electric and magnetic fields may cause electromagnetic interference with adjacent antennas. Therefore, the first and second patch antenna patterns 111*a* and 112*a* may cause electromagnetic interference in a direction from a center of each of the first and second patch antenna patterns 111*a* and 112*a* toward each side thereof. The electromagnetic interference may deteriorate a gain of an adjacent antenna.

When the one side of the upper surface of the first or second patch antenna pattern 111*a* or 112*a* is oblique to one side of the upper surface of the first dielectric layer 151*a*, a direction of the electromagnetic interference of the first or second patch antenna pattern 111*a* or 112*a* may be different from a direction from the center of the first dielectric layer 151*a* toward a side thereof. A chip antenna module according to the disclosure herein may be disposed such that the side of the first dielectric layer 151*a* faces an adjacent antenna. In this case, since the chip antenna module may be compressed together with the adjacent antennas, overall antenna performance of the chip antenna module and the adjacent antennas may be efficiently improved.

Therefore, since a chip antenna module according to the disclosure herein may have a structure in which the one side of the upper surface of the first or second patch antenna pattern 111*a* or 112*a* has an oblique structure on the one side of the upper surface of the first dielectric layer 151*a*, electromagnetic interference with the adjacent antennas may be reduced, and the overall antenna performance of the chip antenna module and the adjacent antenna may be improved.

Figure 5A:
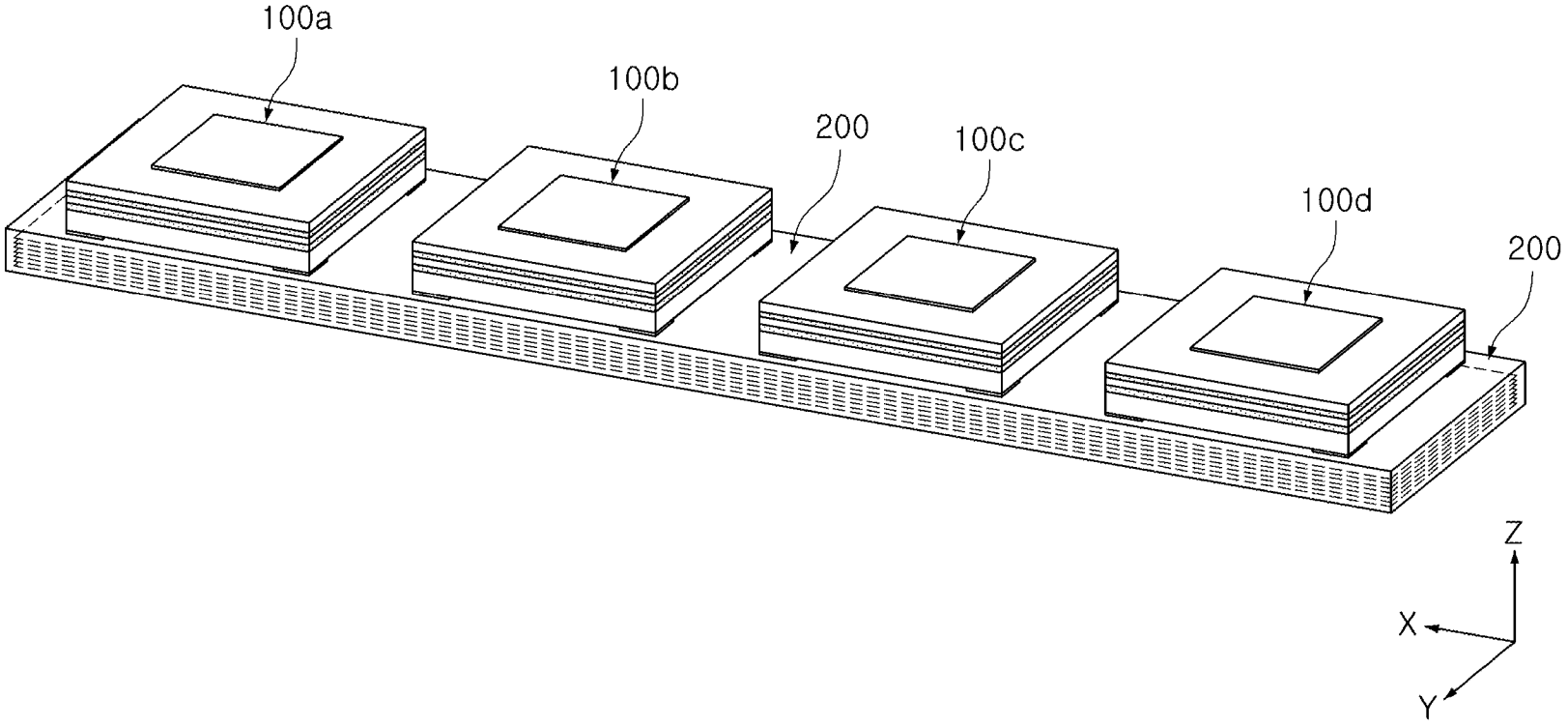
FIG. 5A is a perspective view illustrating an arrangement of chip antenna modules, according to an embodiment.

FIG. 5A is a perspective view illustrating an arrangement of chip antenna modules 100*a*, 100*b*, 100*c*, and 100*d*, according to an embodiment.

Referring to FIG. 5A, the chip antenna modules 100*a*, 100*b*, 100*c*, and 100*d* may be arranged in a structure of [1×n], wherein n is a natural number.

A space between adjacent chip antenna modules among the chip antenna modules 100*a*, 100*b*, 100*c*, and 100*d* may be composed of air or an encapsulant having a dielectric constant lower than that of each dielectric of the chip antenna modules 100*a*, 100*b*, 100*c*, and 100*d*.

Sides of each of the chip antenna modules 100*a*, 100*b*, 100*c*, and 100*d* may act as boundary conditions for a RF signal. Therefore, when the chip antenna modules 100*a*, 100*b*, 100*c*, and 100*d* are arranged to be spaced apart from each other, electromagnetic isolation of the chip antenna modules 100*a*, 100*b*, 100*c*, and 100*d* from each other may be improved.

Figure 5B:
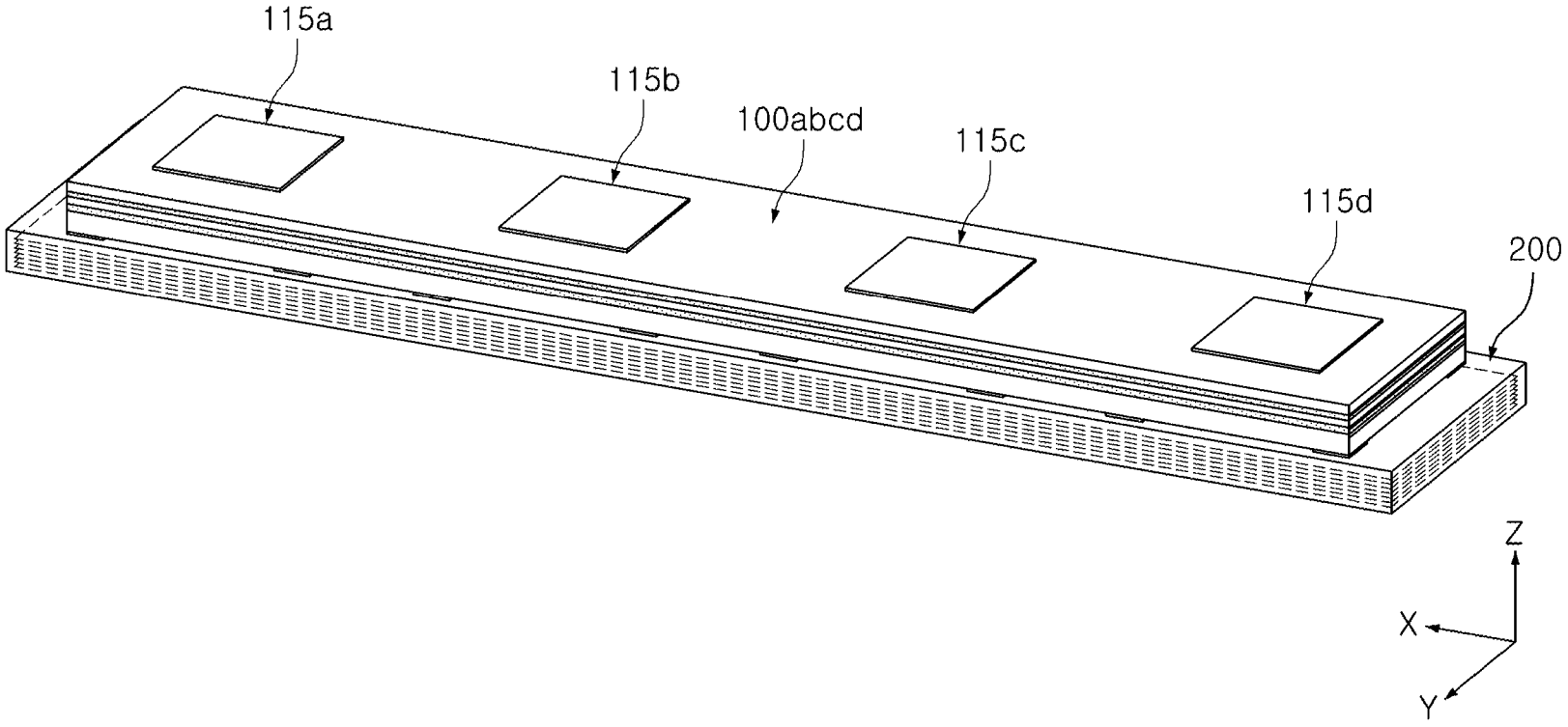
FIG. 5B is a perspective view illustrating an integrated chip antenna module in which the chip antenna modules of FIG. 5A are integrated, according to an embodiment.

FIG. 5B is a perspective view illustrating an integrated chip antenna module 100*abcd* in which the chip antenna modules of FIG. 5A are integrated, according to an embodiment.

Referring to FIG. 5B, an integrated chip antenna module 100*abcd* may have a structure in which chip antenna modules illustrated in FIGS. 1A to 5A are integrated.

For example, a first dielectric layer may be configured as a single first dielectric layer overlapping each of first patch antenna patterns, depending on a design. The first patch antenna patterns may be arranged side by side on the integrated chip antenna module 100*abcd*, to overlap the coupling patch patterns 115*a*, 115*b*, 115*c*, and 115*d* in the Z direction.

Therefore, the overall size of the integrated chip antenna module 100*abcd* may be reduced.

Electromagnetic interference that first feed vias (e.g., the first feed vias 121*a* and 121*b*) may give to each other may be reduced by the shielding vias 130*a* described above. Therefore, the integrated chip antenna module 100*abcd* may have a further reduced size, and may prevent deterioration of antenna performance due to the size reduction.

Figure 6A:
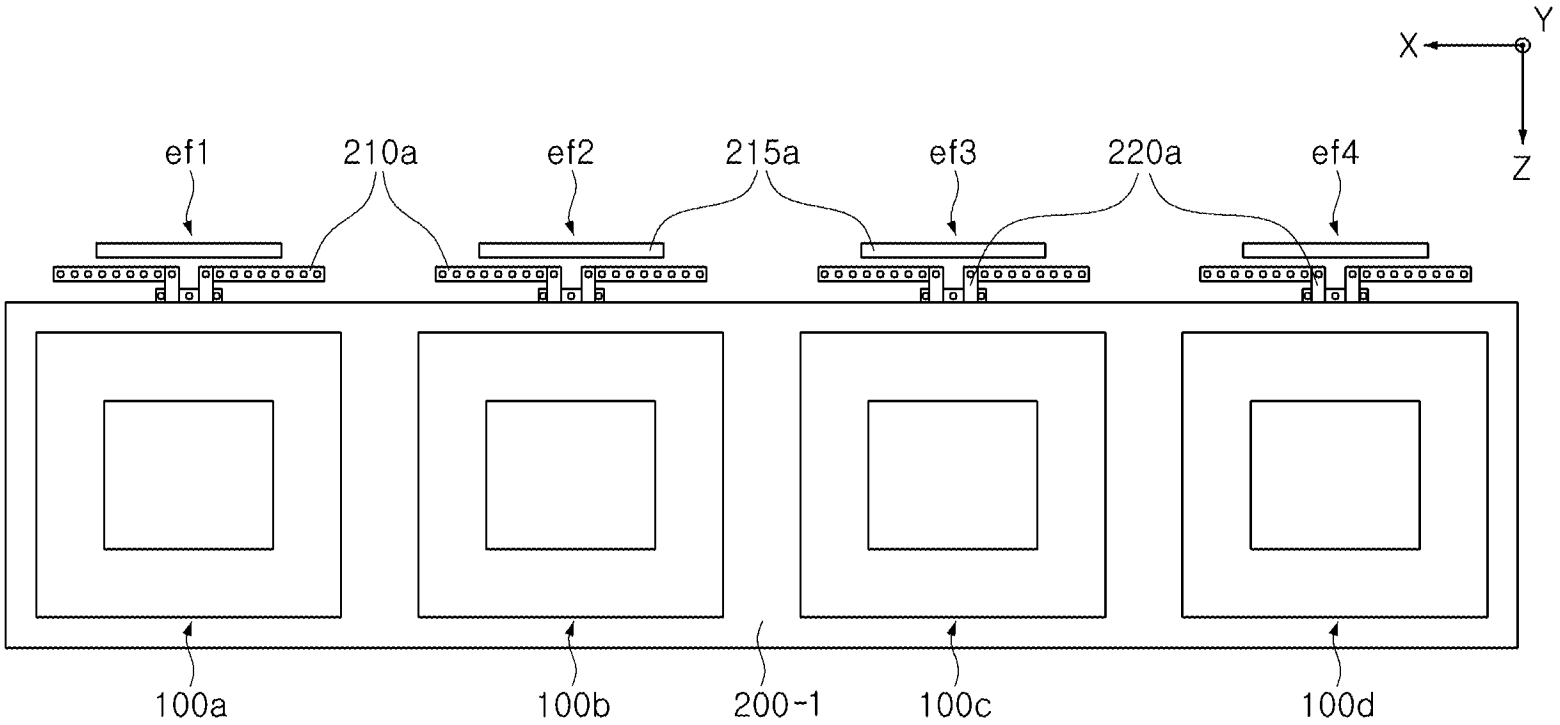
FIG. 6A is a plan view illustrating end-fire antennas included in a connection member disposed below chip antenna modules, according to an embodiment.

FIG. 6A is a plan view illustrating end-fire antennas ef1, ef2, ef3, and ef4 included in a connection member 200-1 disposed below the chip antenna modules 100*a*, 100*b*, 100*c*, and 100*d*, according to an embodiment.

Referring to FIG. 6A, the connection member 200-1 may include end-fire antennas ef1, ef2, ef3, and ef4 arranged in parallel to the chip antenna modules 100*a*, 100*b*, 100*c*, and 100*d*. A radiation pattern of a RF signal may be formed in the horizontal direction (e.g., the X direction and/or the Y direction).

Each of the end-fire antennas ef1, ef2, ef3, and ef4 may include end-fire antenna patterns 210*a* and a feed line 220*a*, and may further include a director pattern 215*a*.

Since the chip antenna modules 100*a*, 100*b*, 100*c*, and 100*d* include shielding vias arranged to surround a first feed via, electromagnetic isolation of the end-fire antennas ef1, ef2, ef3, and ef4 may be improved. Therefore, gains of the chip antenna modules 100*a*, 100*b*, 100*c*, and 100*d* may be further improved.

Figure 6B:
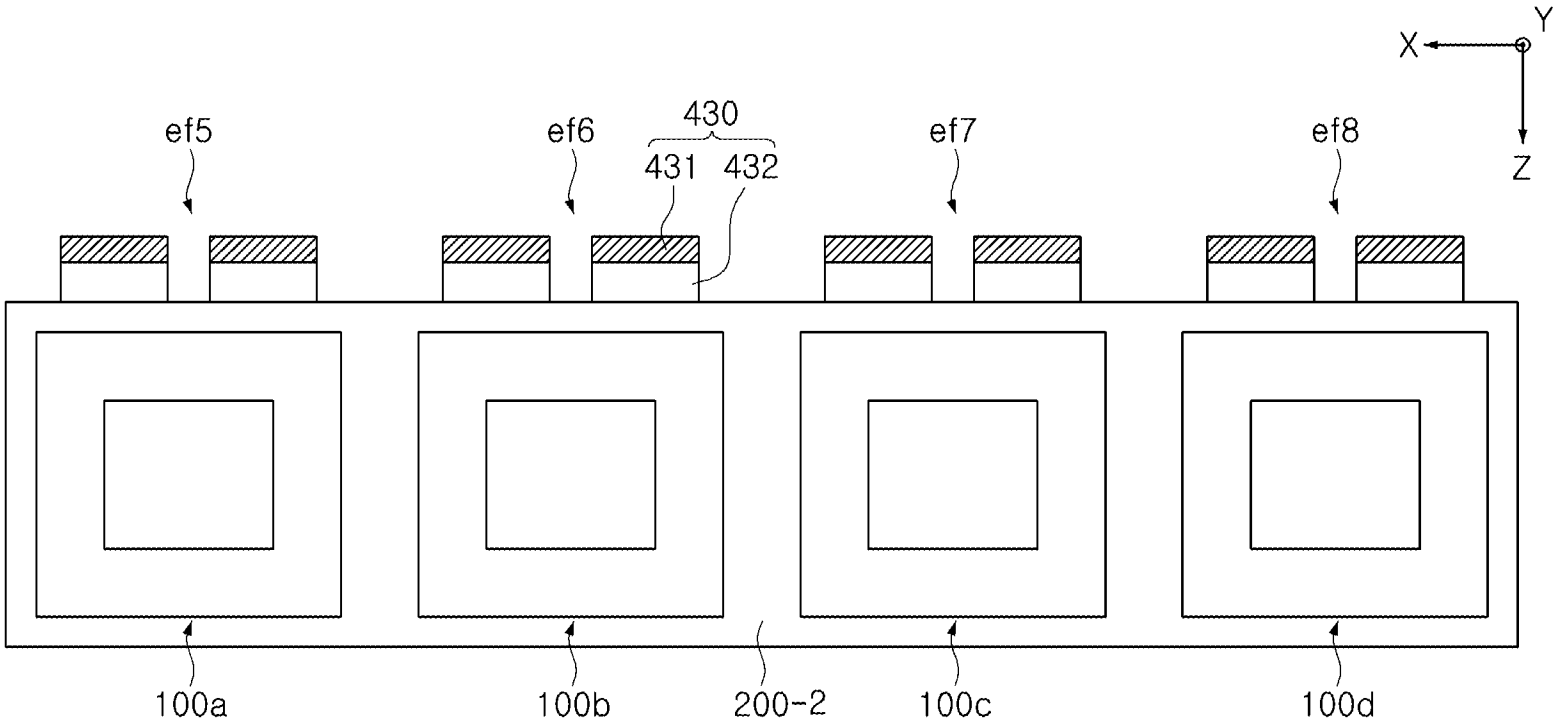
FIG. 6B is a plan view illustrating end-fire antennas disposed on a connection member disposed below chip antenna modules, according to an embodiment.

FIG. 6B is a plan view illustrating end-fire antennas ef5, ef6, ef7, and ef8 disposed on a connection member 200-2 disposed below chip antenna modules, according to an embodiment.

Referring to FIG. 6B, since the connection member 200-2 may include the end-fire antennas ef5, ef6, ef7, and ef8 arranged in parallel to the chip antenna modules 100*a*, 100*b*, 100*c*, and 100*d*. A radiation pattern of a RF signal may be formed in the horizontal direction.

The end-fire antennas ef5, ef6, ef7, and ef8 may include a radiator 431 and a dielectric 432, respectively.

FIGS. 7A to 7F are views illustrating a methods of manufacturing a chip antenna module, according to embodiments.

Figure 7A:
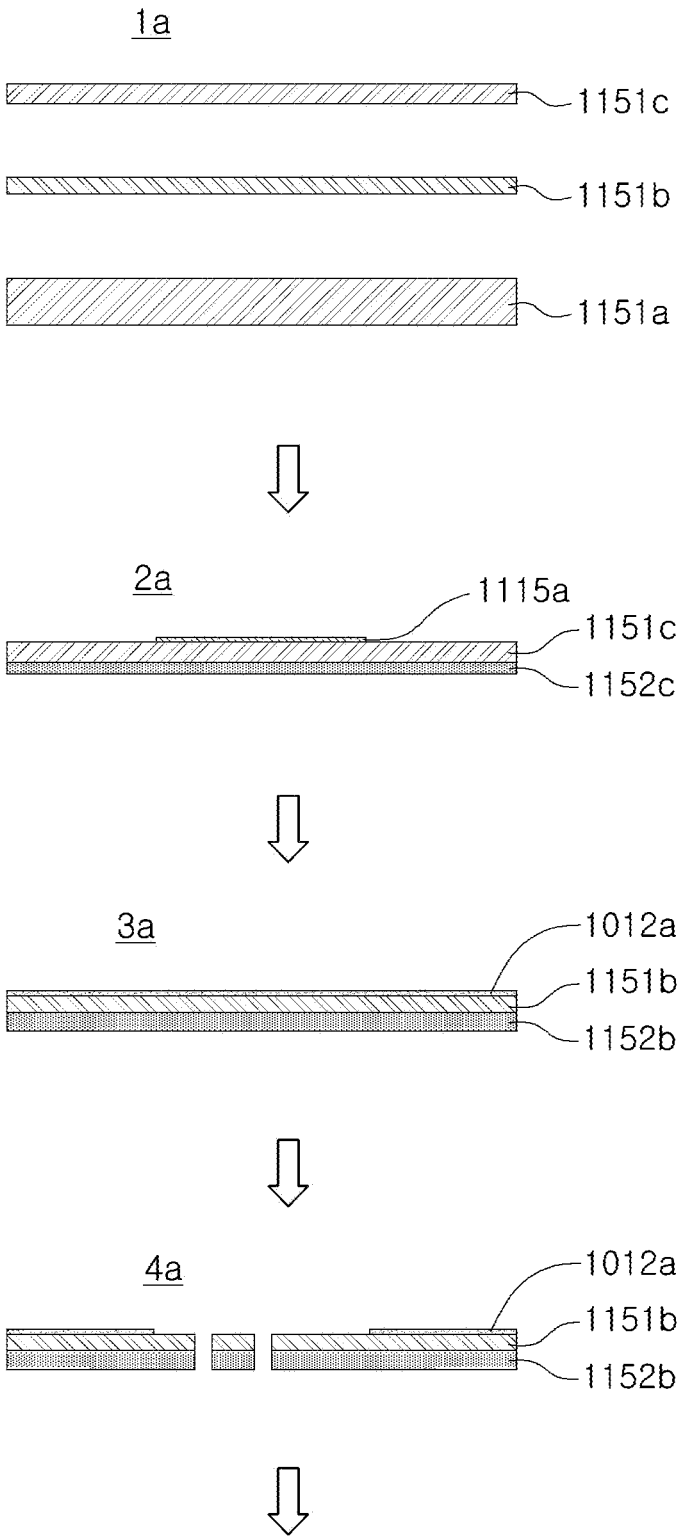
FIGS. 7A to 7F are views illustrating a methods of manufacturing a chip antenna module, according to embodiments.
Figure 7B:
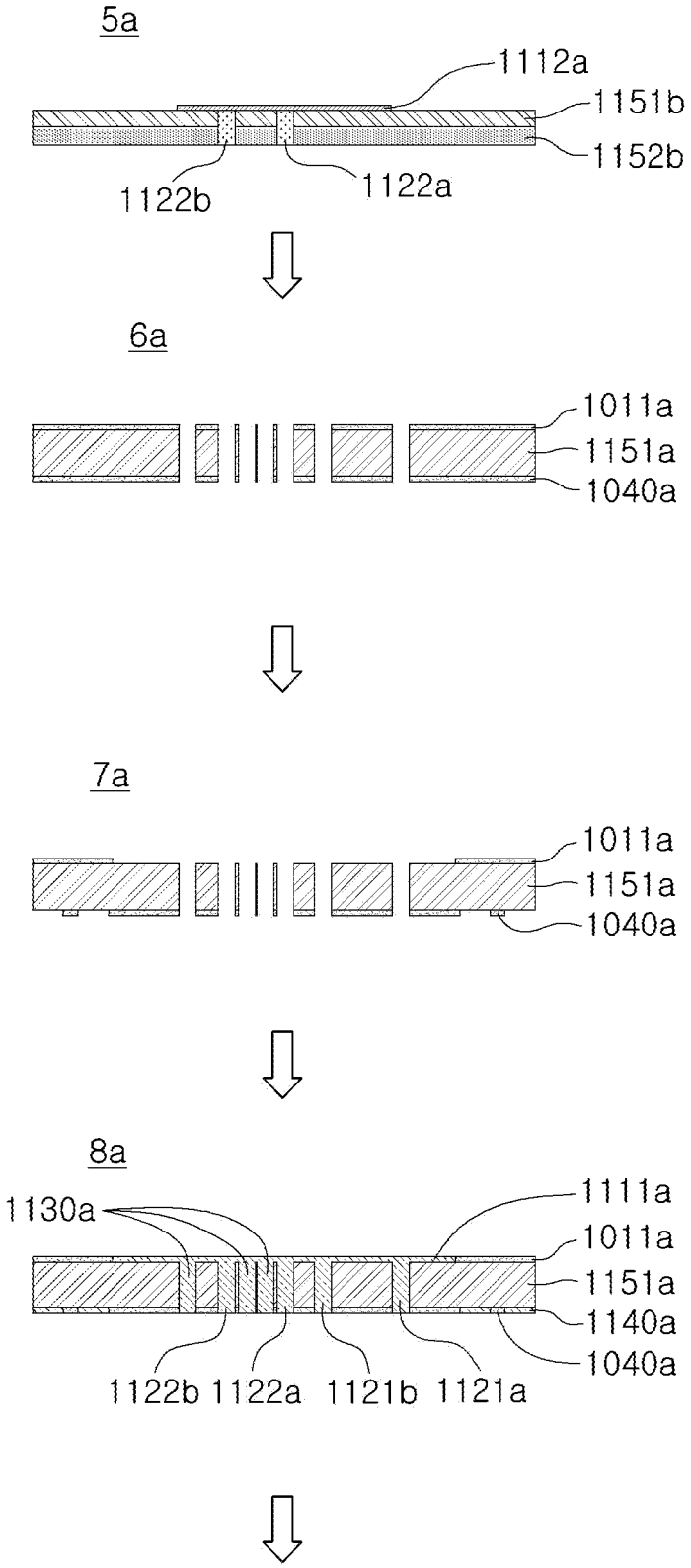
Figure 7C:
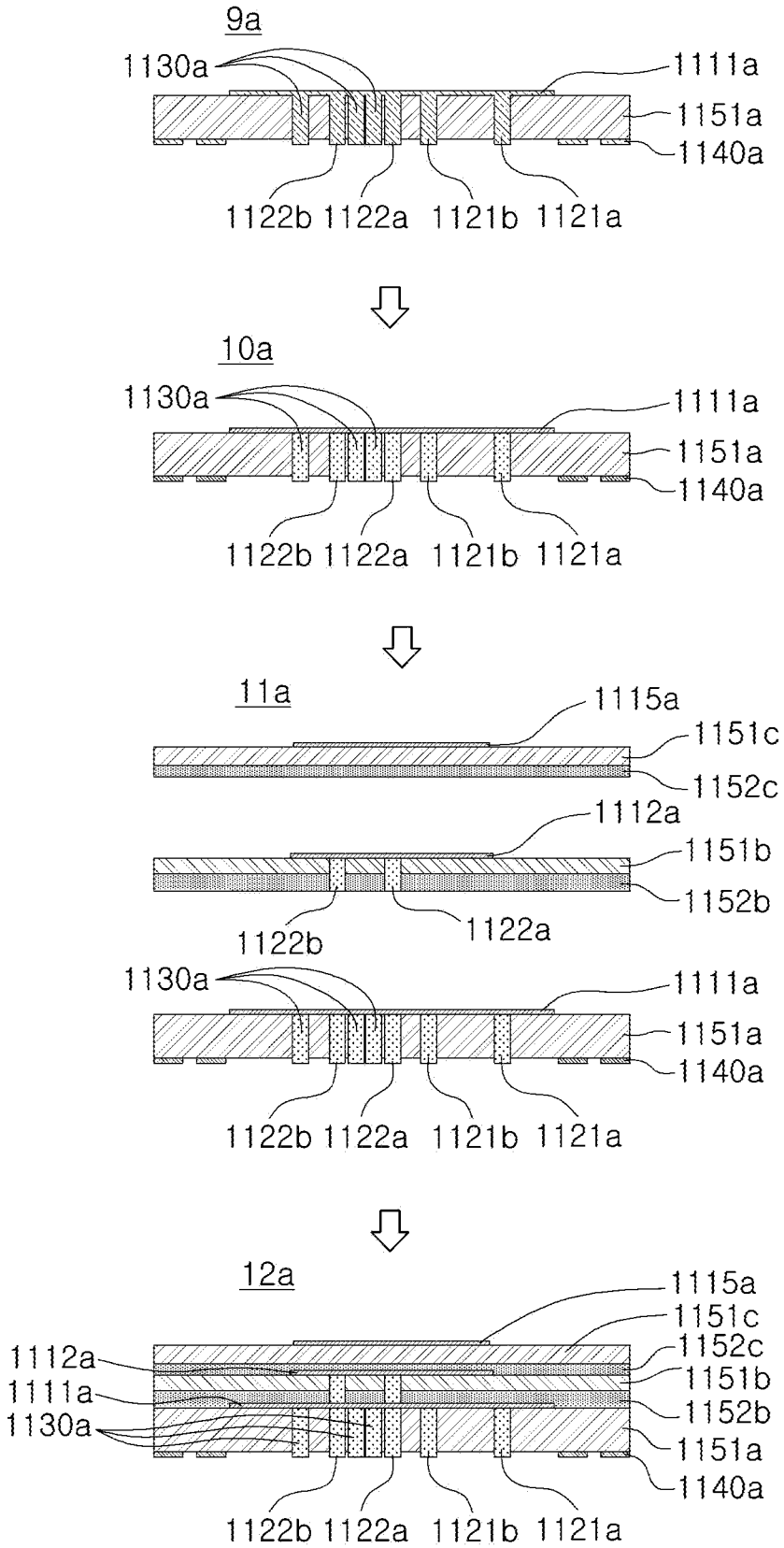

Referring to FIGS. 7A to 7C, a chip antenna module may be manufactured by at least a portion of first to twelfth operations 1*a*, 2*a*, 3*a*, 4*a*, 5*a*, 6*a*, 7*a*, 8*a*, 9*a*, 10*a*, 11*a*, and 12*a*.

Referring to FIG. 7A, first, third, and fifth dielectric layers 1151*a*, 1151*b*, and 1151*c* may be prepared in the first operation 1*a*. In the second operation 2*a*, a fourth dielectric layer 1152*c* and a coupling patch pattern 1115*a* may be arranged on lower and upper surfaces, respectively, of the fifth dielectric layer 1151*c*. In the third operation 3*a*, a second dielectric layer 1152*b* and a film 1012*a* may be arranged on lower and upper surfaces, respectively, of the third dielectric layer 1151*b*. In the fourth operation 4*a*, portions of the second and third dielectric layers 1152*b* and 1151*b* and the film 1012*a* respectively corresponding to arrangement spaces of second feed vias 1122*a* and 1122*b* and a second patch antenna 1112*a* pattern may be removed.

Referring to FIG. 7B, in the fifth operation 5*a*, first portions of the second feed vias 1122*a* and 1122*b* may be formed in the second and third dielectric layers 1152*b* and 1151*b*, and the second patch antenna pattern 1112*a* may be formed on the third dielectric layer 1151*b*. In the sixth operation 6*a*, films 1011*a* and 1040*a* may be arranged on upper and lower surfaces, respectively, of the first dielectric layer 1151*a*, and arrangement spaces of first feed vias 1121*a* and 1121*b* and shielding vias 1130*a* may be formed. In the seventh operation 7*a*, the first dielectric layer 1151*a* may provide an arrangement space of a first patch antenna pattern 1111*a* and a solder layer 1140*a*. In the eighth operation 8*a*, the first feed vias 1121*a* and 1121*b*, shielding vias 1130*a*, a first patch antenna pattern 1111*a*, and a solder layer 1140*a* may be formed in the first dielectric layer 1151*a*. Additionally, in the eighth operation 8*a*, second portions of the second feed vias 1122*a* and 1122*b* may be formed in the first dielectric layer 1151*a* so as to extend through through-holes in the first patch antenna pattern 1111*a*.

Referring to FIG. 7C, remaining films of the first dielectric layer 1151*a* may be removed in the ninth operation 9*a*. In the tenth operation 10*a*, surfaces of the first patch antenna pattern 1111*a* and the solder layer 1140*a* may be plated. In an eleventh operation 11*a*, the first, second, third, fourth, and fifth dielectric layers 1151*a*, 1152*b*, 1151*b*, 1152*c*, and 1151*c* may be aligned with each other. In the twelfth operation 12*a*, the first, second, third, fourth, and fifth dielectric layers 1151*a*, 1152*b*, 1151*b*, 1152*c*, and 1151*c* may be bonded to each other. Further, in the twelfth operation 12*a*, the first portions of the second feed vias 1122*a* and 1122*b* are connected to the second portions of the second feed vias 1122*a* and 1122*b*, respectively.

Figure 7D:
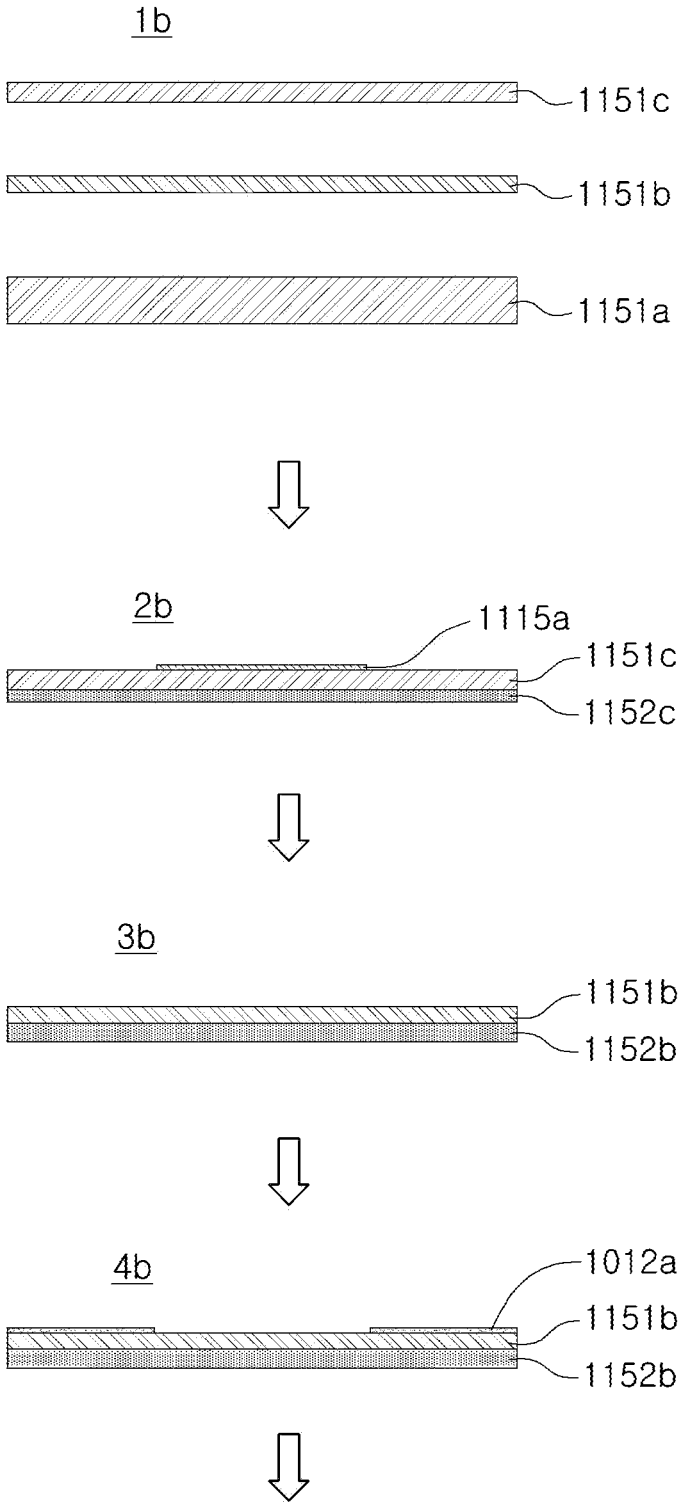
Figure 7E:
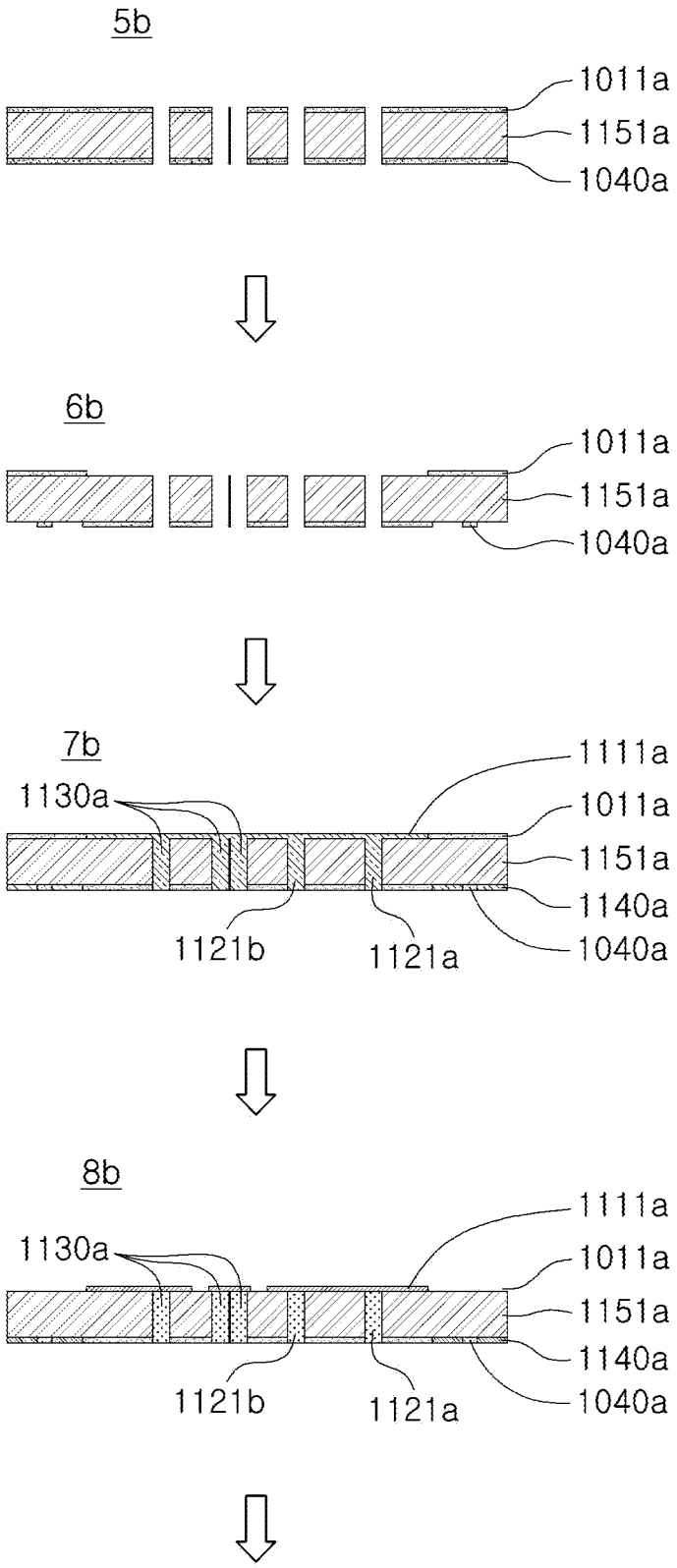
Figure 7F:
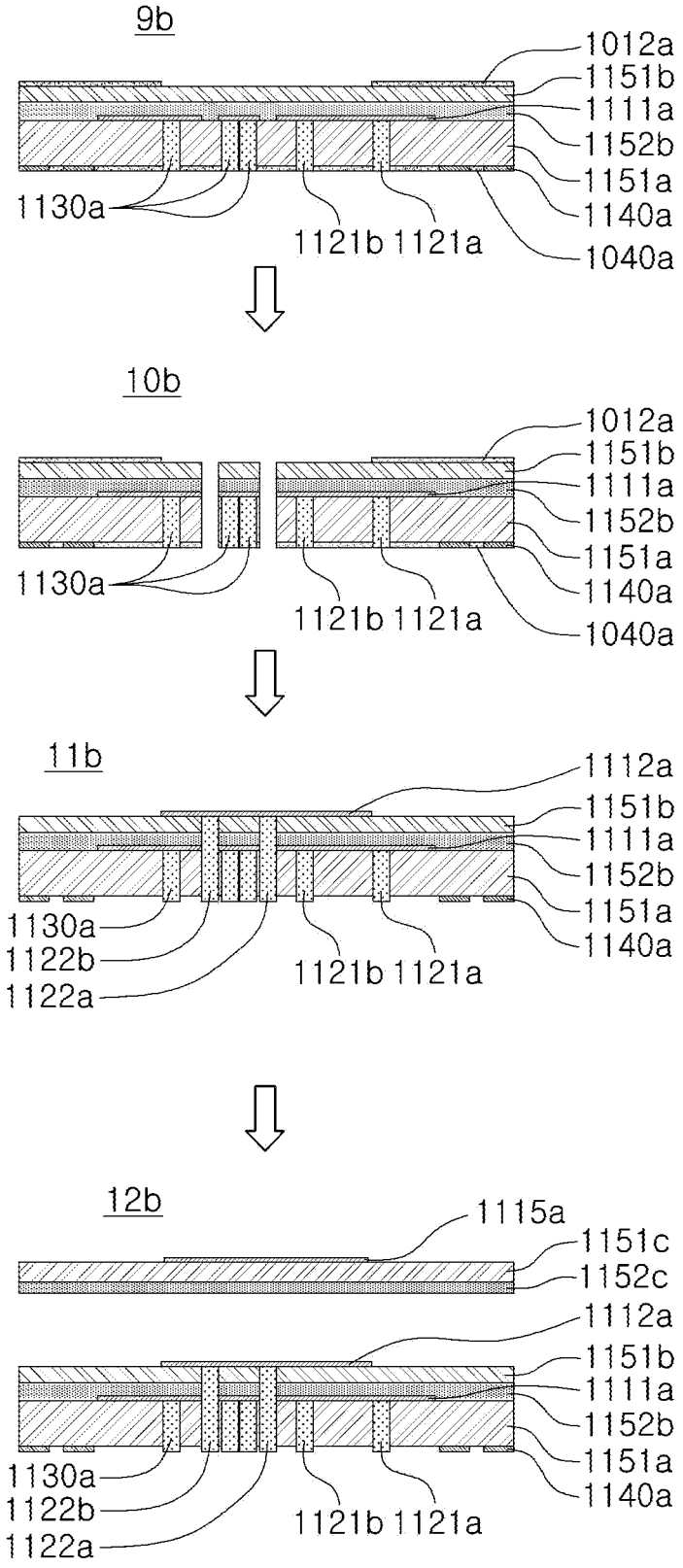

Referring to FIGS. 7D to 7F, a chip antenna module may be manufactured by at least a portion of first to twelfth operations 1*b*, 2*b*, 3*b*, 4*b*, 5*b*, 6*b*, 7*b*, 8*b*, 9*b*, 10*b*, 11*b*, and 12*b*.

Referring to FIG. 7D, first, third, and fifth dielectric layers 1151*a*, 1151*b*, and 1151*c* may be prepared in the first operation 1*b*. In the second operation 2*b*, a fourth dielectric layer 1152*c* and a coupling patch pattern 1115*a* may be disposed on lower and upper surfaces, respectively, of the fifth dielectric layer 1151*c*. In the third operation 3*b*, a second dielectric layer 1152*b* may be disposed on a lower surface of the third dielectric layer 1151*b*. In the fourth operation 4*b*, a film 1012*a* may be disposed on remaining surface of the third dielectric layer 1151*b*, except for a portion corresponding to an arrangement space of the second patch antenna pattern.

Referring to FIG. 7E, in the fifth operation 5*b*, films 1011*a* and 1040*a* may be disposed on upper and lower surfaces of the first dielectric layer 1151*a*, respectively, and a portion corresponding to an arrangement space of the first feed vias 1121*a* and 1121*b* may be removed from the first dielectric layer 1151*a*. In the sixth operation 6*b*, portions corresponding to arrangement spaces of the first patch antenna pattern 1111*a* and the solder layer 1140*a*, among the films 1011*a* and 1040*a* formed on the upper and lower surfaces of the first dielectric layer 1151*a*, may be removed. In the seventh operation 7*b*, the first patch antenna pattern 1111*a* and the solder layer 1140*a* may be formed on upper and lower surfaces of the first dielectric layer 1151*a*, respectively, and the first feed vias 1121*a* and 1121*b* and the shielding vias 1130*a* may be formed in the first dielectric layer 1151*a*. In the eighth operation 8*b*, remaining films on the upper and lower surfaces of the first dielectric layer 1151*a* may be removed.

Referring to FIG. 7F, in the ninth operation 9*b*, the first, second, and third dielectric layers 1151*a*, 1152*b*, and 1151*b* may be stacked. In the tenth operation 10*b*, portions of the first, second, and third dielectric layers 1151*a*, 1152*b*, and 1151*b* corresponding to arrangement spaces of second feed vias 1122*a* and 1122*b* may be removed. In the eleventh operation 11*b*, the second feed vias 1122*a* and 1122*b*, and the second patch antenna pattern 1112*a* may be formed in the first, second, and third dielectric layers 1151*a*, 1152*b*, and 1151*b*. A film on the third dielectric layer 1151*b* may be removed, and the first, second, third, fourth, and fifth dielectric layers 1151*a*, 1152*b*, 1151*b*, 1152*c*, and 1151*c* may be aligned and bonded with each other in the twelfth operation 12*b*.

For example, the patch antenna pattern 1111*a*/1112*a*, the coupling patch pattern 1115*a*, and the feed via 1121*a*/1121*b*/1122*a*/1122*b* may be formed as a conductive paste is dried in a coated and/or filled state.

For example, portions in which the feed via 121*a*/121*b*/122*a*/122*b* is disposed in the first, second, and third dielectric layers 1151*a*, 1152*b*, and 1151*b* may be removed by laser processing.

Figure 8A:
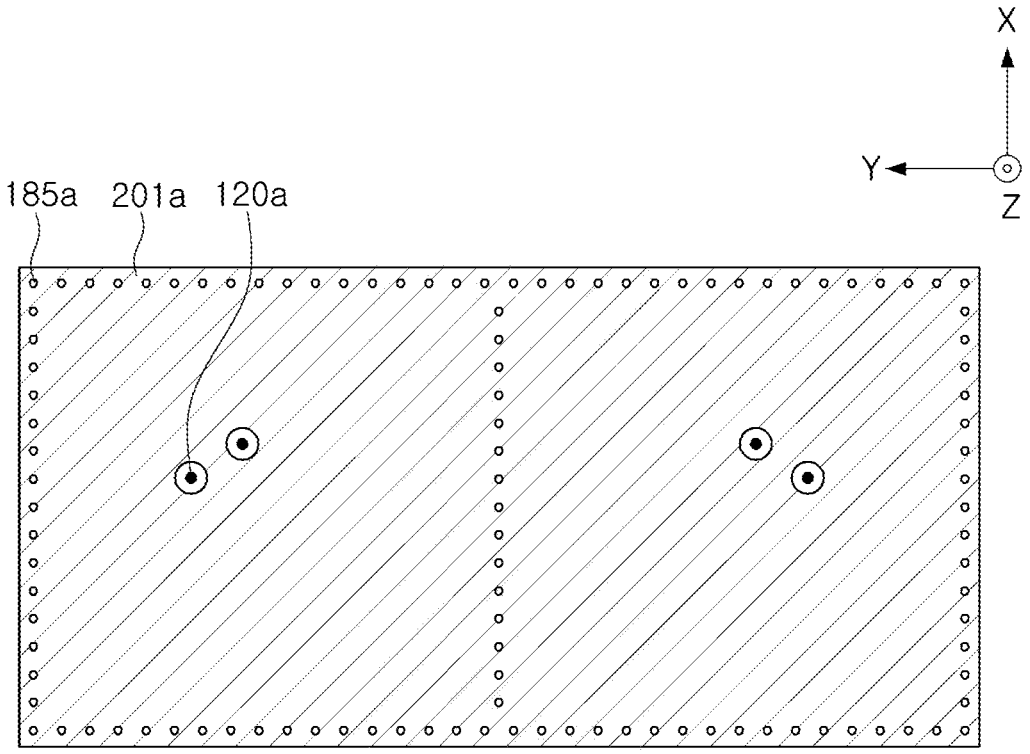
FIG. 8A is a plan view illustrating a first ground plane of a connection member included in an electronic device, according to an embodiment.
Figure 8B:
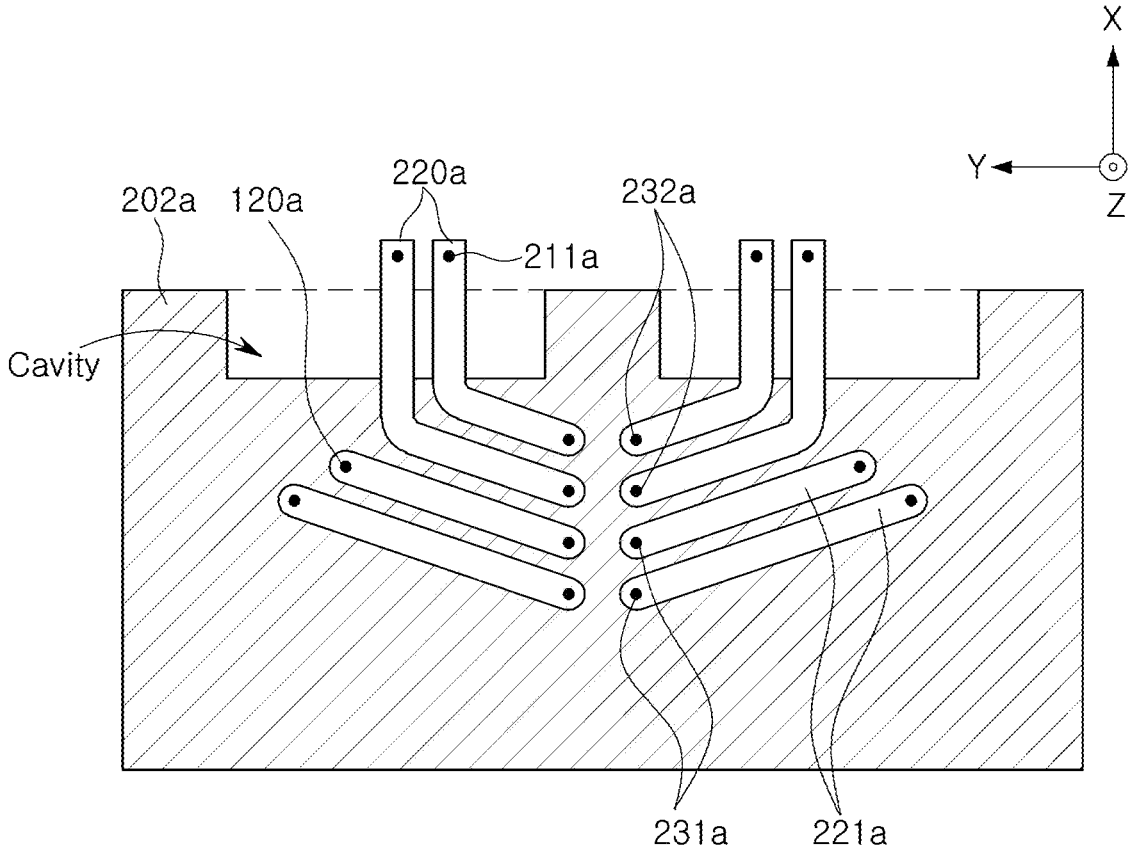
FIG. 8B is a plan view illustrating a feed line below the first ground plane of FIG. 8A.
Figure 8C:
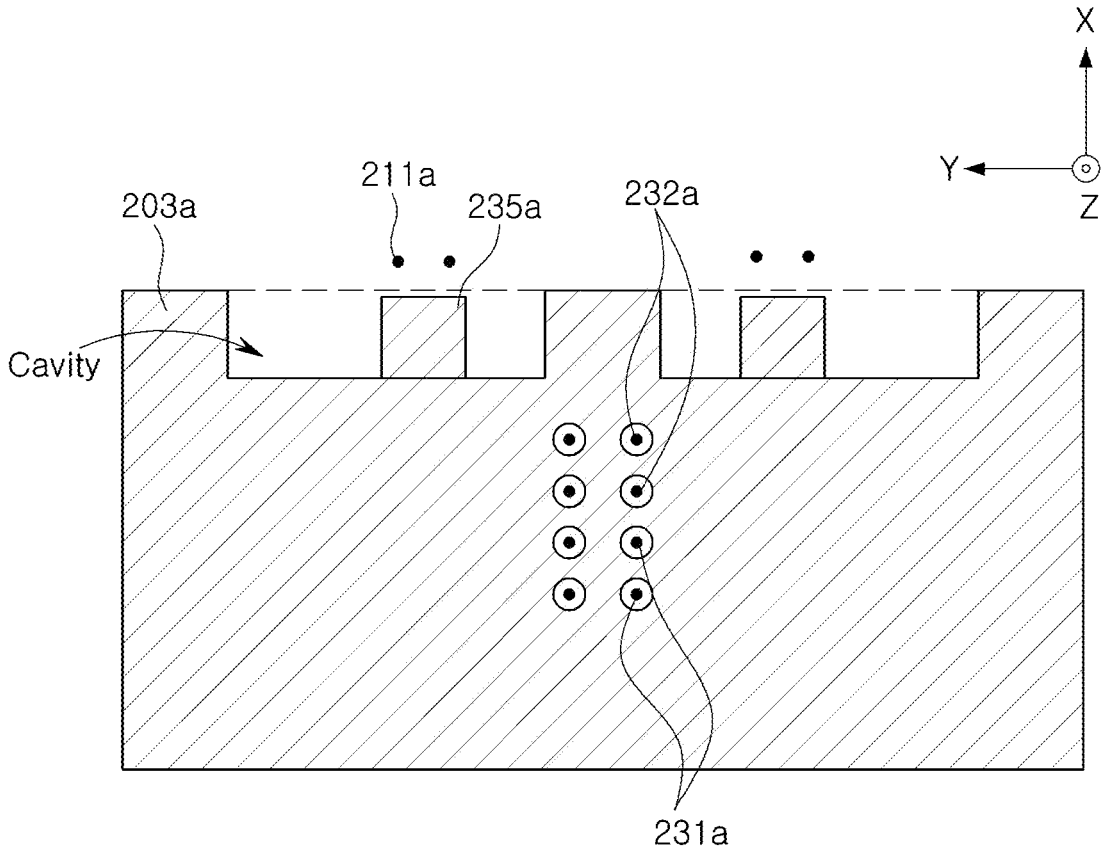
FIG. 8C is a plan view illustrating first and second wiring vias and a second ground plane below the feed line of FIG. 8B.
Figure 8D:
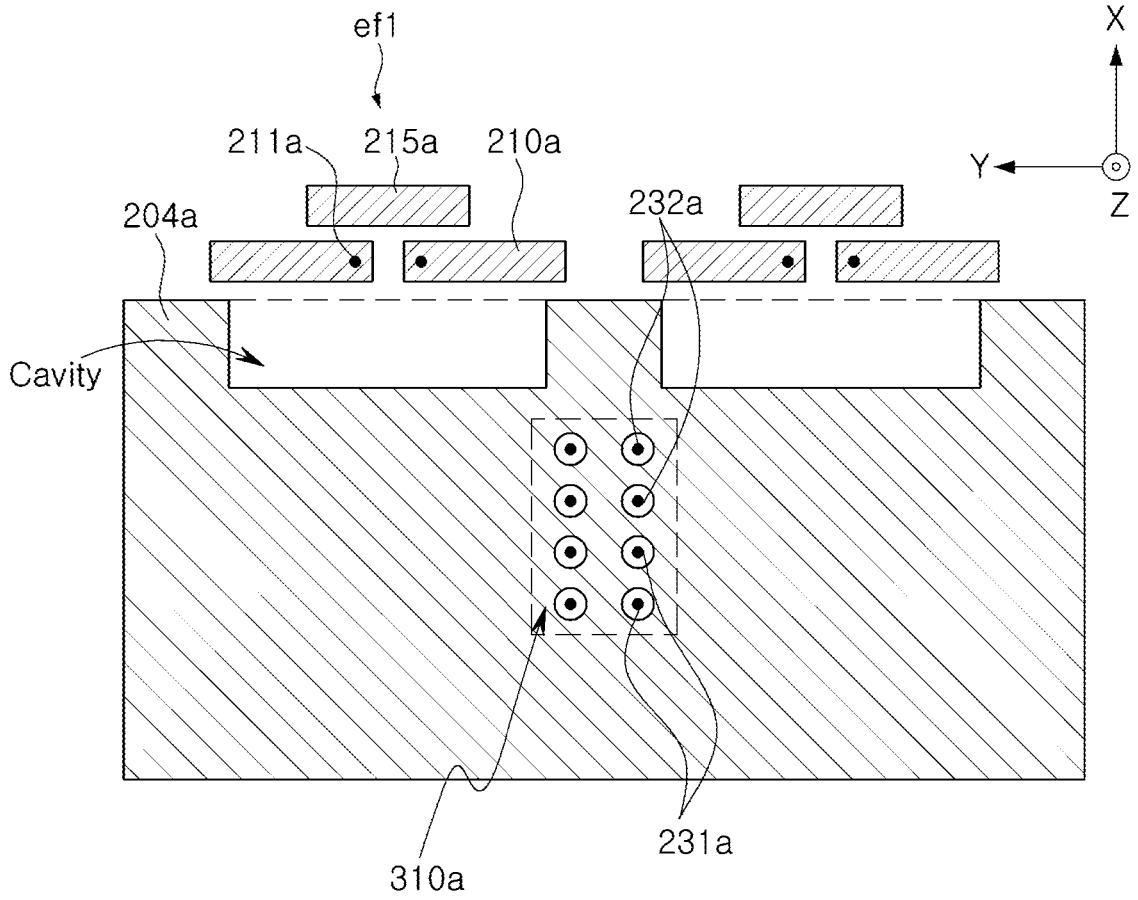
FIG. 8D is a plan view illustrating an IC arrangement region and an end-fire antenna below the second ground plane of FIG. 8C.

FIG. 8A is a plan view illustrating the first ground plane 201*a* of a connection member (e.g., the connection member 200) included in an electronic device, according to an embodiment. FIG. 8B is a plan view illustrating a feed line 221*a* below the first ground plane 201*a* of FIG. 8A, FIG. 8C is a plan view illustrating first and second wiring vias 231*a* and 232*a* and a second ground plane 203*a* below the feed line 221*a* of FIG. 8B, and FIG. 8D is a plan view illustrating an IC arrangement region and an end-fire antenna ef1 below the second ground plane 203*a* of FIG. 8C.

Referring to FIGS. 8A to 8D, a feed via 120*a* may comprehensively correspond to the above-described first and second feed vias 121*a*, 121*b*, 122*a*, 122*b*, 1121*a*, 1121*b*, 1122*a*, 1122*b*, a patch antenna pattern may comprehensively correspond to the above-described first and second patch antenna patterns 111*a*, 112*a*, 1111*a*, and 1112*a*, and chip antenna modules may be arranged in a horizontal direction (for example, the X direction and/or the Y direction).

Referring to FIG. 8A, the first ground plane 201*a* may have a through-hole through which the feed via 120*a* passes, and may electromagnetically shield between the patch antenna pattern 110*a* and the feed line 221*a*. A peripheral via 185*a* may extend in an upward direction (e.g., in the Z direction), and may be connected to the second solder layer 180*a* described above.

Referring to FIG. 8B, the wiring ground plane 202*a* may surround at least a portion of an end-fire antenna feed line 220*a* and the feed line 221*a*, respectively. The end-fire antenna feed line 220*a* may be electrically connected to a second wiring via 232*a*, and the feed line 221*a* may be electrically connected to the first wiring via 231*a*. The wiring ground plane 202*a* may electromagnetically shield between the end-fire antenna feed line 220*a* and the feed line 221*a*. One end of the end-fire antenna feed line 220*a* may be connected to a second feed via 211*a*.

Referring to FIG. 8C, the second ground plane 203*a* may have through-holes through which the first wiring via 231*a* and the second wiring via 232*a* pass, respectively, and may have a coupling ground pattern 235*a*. The second ground plane 203*a* may electromagnetically shield between a feed line (e.g., the feed line 221*a* and the end-fire antenna feed line 220*a*) and an IC 310*a* (FIG. 8D).

Referring to FIG. 8D, the IC ground plane 204*a* may have through-holes through which the first wiring via 231*a* and the second wiring via 232*a* respectively pass. The IC 310*a* may be disposed under the IC ground plane 204*a*, and may be electrically connected to the first wiring via 231*a* and the second wiring via 232*a*. The end-fire antenna pattern 210*a* and the director pattern 215*a* of the end-fire antenna ef1 may be arranged on substantially the same level as the IC ground plane 204*a*.

The IC ground plane 204*a* may provide a ground used in circuits of the IC 310*a* and/or passive components as the IC 310*a* and/or the passive components. Depending on a design, the IC ground plane 204*a* may provide a power supply and a path for transmission of signals used in the IC 310*a* and/or the passive components. Therefore, the IC ground plane 204*a* may be electrically connected to the IC 310*a* and/or the passive components.

The wiring ground plane 202*a*, the second ground plane 203*a*, and the IC ground plane 204*a* may have a recessed shape to form a cavity. Therefore, the end-fire antenna pattern 210*a* may be further disposed closer to the IC ground plane 204*a*.

Vertical relationships and shapes of the wiring ground plane 202*a*, the second ground plane 203*a*, and the IC ground plane 204*a* may vary, depending on a design.

Figure 9A:
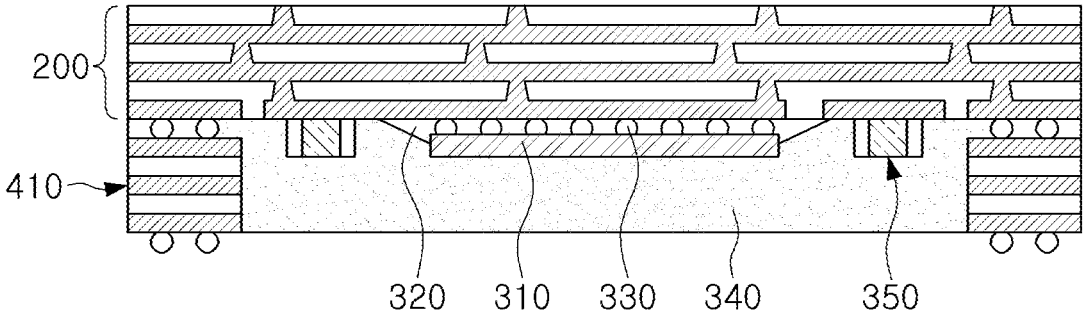
FIGS. 9A and 9B are side views illustrating the portions illustrated in FIGS. 8A to 8D and structures below the portions illustrated in FIGS. 8A to 8D.
Figure 9B:
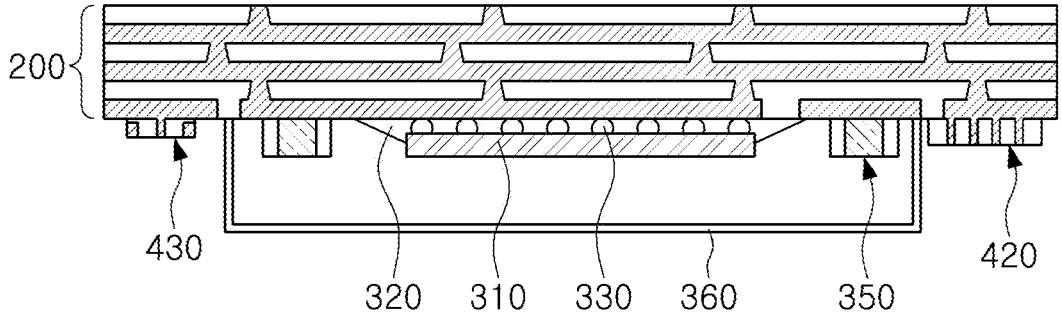

FIGS. 9A and 9B are side views illustrating the portions illustrated in FIGS. 8A to 8D and structures below the portions illustrated in FIGS. 8A to 8D.

Referring to FIG. 9A, a chip antenna module, according to an embodiment, may include at least a portion of the connection member 200, an IC 310, an adhesive member 320, an electrical connection structure 330, an encapsulant 340, a passive component 350, and a core member 410.

The connection member 200 may have a structure similar to the structure described above with reference to FIGS. 1A to 7C.

The IC 310 may be the same as the above-described IC 310*a*, and may be disposed under the connection member 200. The IC 310 may be electrically connected to wiring of the connection member 200, to transmit or receive an RF signal, and may be electrically connected to a ground plane of the connection member 200, to receive ground. For example, the IC 310 may perform at least some of frequency conversion, amplification, filtering, phase control, and power generation, to generate a converted signal.

The adhesive member 320 may bond the IC 310 and the connection member 200 to each other.

The electrical connection structure 330 may electrically connect the IC 310 and the connection member 200. For example, the electrical connection structure 330 may have a structure such as a solder ball, a pin, a land, and a pad. The electrical connection structure 330 may have a lower melting point than the wiring and the ground plane of the connection member 200, to electrically connect the IC 310 and the connection member 200 through a predetermined process using the lower melting point of the connection structure 330.

The encapsulant 340 may encapsulate at least a portion of the IC 310, and may improve heat dissipation performance and impact protection performance of the IC 310. For example, the encapsulant 340 may be implemented with a photo imageable encapsulant (PIE), an Ajinomoto build-up film (ABF), an epoxy molding compound (EMC), or the like.

The passive component 350 may be disposed on a lower surface of the connection member 200, and may be electrically connected to the wiring and/or the ground plane of the connection member 200 through the electrical connection structure 330. For example, the passive component 350 may include at least a portion of a capacitor (e.g., a multi-layer ceramic capacitor (MLCC)), an inductor, and a chip resistor.

The core member 410 may be disposed under the connection member 200, and may be electrically connected to the connection member 200, to receive an intermediate frequency (IF) signal or a base band signal from the outside and transmit the received IF signal to the IC 310, or receive the IF signal or the baseband signal from the IC 310 to transmit the received IF signal to the outside. In this case, a frequency (e.g., 24 GHz, 28 GHz, 36 GHz, 39 GHz, or 60 GHz) of the RF signal may be greater than a frequency (e.g., 2 GHz, 5 GHz, 10 GHz, etc.) of the IF signal.

For example, the core member 410 may transmit or receive an IF signal or a baseband signal to or from the IC 310 through a wiring that may be included in the IC ground plane of the connection member 200. Since the first ground plane of the connection member 200 (e.g., the first ground plane 201*a*) may be disposed between the IC ground plane (e.g., the IC ground plane 204*a*) and the wiring, the IF signal or the baseband signal and the RF signal may be electrically isolated in the chip antenna module.

Referring to FIG. 9B, a chip antenna module, according to an embodiment, may include at least a portion of a shielding member 360, a connector 420, and a chip end-fire antenna 430.

The shielding member 360 may be disposed under the connection member 200 to confine the IC 310 together with the connection member 200. For example, the shielding member 360 may be arranged to cover the IC 310 and the passive component 350 together (e.g., conformal shield) or to cover each of the IC 310 and the passive component 350 (e.g., a compartment shield). For example, the shielding member 360 may have a shape of a hexahedron having one surface open, and may have a hexahedral receiving space through coupling with the connection member 200. The shielding member 360 may be made of a material having high conductivity such as copper to have a short skin depth, and may be electrically connected to the ground plane of the connection member 200. Therefore, the shielding member 360 may reduce electromagnetic noise that may be received by the IC 310 and the passive component 350.

The connector 420 may have a connection structure of a cable (e.g., a coaxial cable, a flexible PCB), may be electrically connected to the IC ground plane of the connection member 200, and may have a role similar to that of the core member 410 described above. For example, the connector 420 may receive an IF signal, a baseband signal and/or a power from a cable, or provide an IF signal and/or a baseband signal to a cable.

The chip end-fire antenna 430 may transmit or receive an RF signal in support of a chip antenna module, according to an embodiment. For example, the chip end-fire antenna 430 may include a dielectric block having a dielectric constant greater than that of the insulating layer, and electrodes disposed on both surfaces of the dielectric block. One of the electrodes may be electrically connected to the wiring of the connection member 200, and the other of the electrodes may be electrically connected to the ground plane of the connection member 200.

Figure 10A:
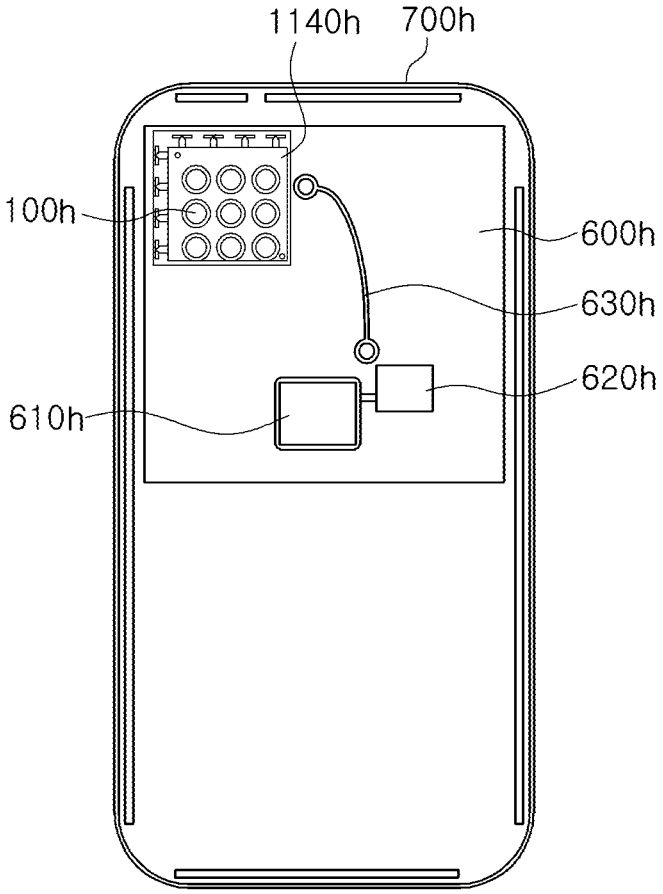
FIGS. 10A and 10B are plan views illustrating electronic devices including chip antenna modules, according to embodiments.
Figure 10B:
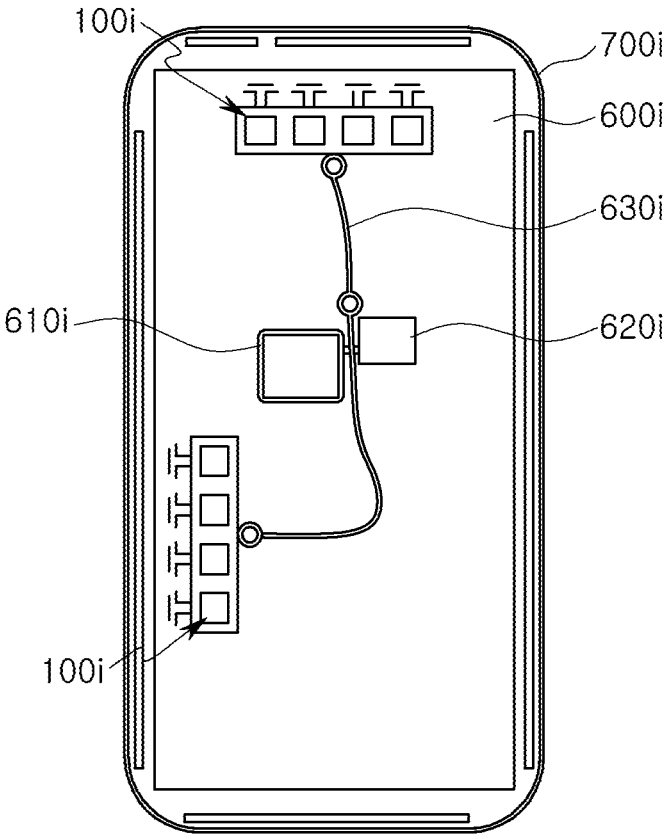

FIGS. 10A and 10B are plan views illustrating electronic devices 700*h* and 700*i* including chip antenna modules 100*h* and 100*i*, respectively, according to embodiments.

Referring to FIG. 10A, a chip antenna module 100*h* may be included in an antenna apparatus disposed adjacent to a lateral boundary of the electronic device 700*h* on a set substrate 600*h* of the electronic device 700*h*.

The electronic device 700*h* may be a smartphone, a personal digital assistant, a digital video camera, a digital still camera, a network system, a computer, a monitor, a tablet, a laptop, a netbook, a television, a video game, a smart watch, an automotive, or the like, but is not limited to such devices. Additionally, the electronic device may have a polygonal shape, but is not limited to such a shape.

A communications module 610*h* and a baseband circuit 620*h* may also be disposed on the set substrate 600*h*. The chip antenna module 100*h* may be electrically connected to the communications module 610*h* and/or the baseband circuit 620*h* through a coaxial cable 630*h*.

The communications module 610*h* may include at least a portion of: a memory chip, such as a volatile memory (e.g., a DRAM), a non-volatile memory (e.g., a ROM), a flash memory, or the like; an application processor chip, such as a central processor (e.g., a CPU), a graphics processor (e.g., a GPU), a digital signal processor, a cryptographic processor, a microprocessor, a microcontroller, or the like; and a logic chip, such as an analog-to-digital converter, an application-specific IC (ASIC), or the like, to perform a digital signal process.

The baseband circuit 620*h* may perform an analog-to-digital conversion, amplification in response to an analog signal, filtering, and frequency conversion to generate a base signal. The base signal input/output from the baseband circuit 620*h* may be transferred to the chip antenna module 100*h* through a cable.

For example, the base signal may be transmitted to the IC through an electrical connection structure, a core via, and a wiring. The IC may convert the base signal into an RF signal in a millimeter wave (mmWave) band.

Still referring to FIG. 10A, a dielectric layer 1140*h* may be filled in a region in which a pattern, a via, a plane, a strip, a line, and an electrical connection structure are not arranged in the chip antenna module 100*h*. For example, the dielectric layer 1140*h* may be implemented with a thermosetting resin such as FR4, liquid crystal polymer (LCP), low temperature co-fired ceramic (LTCC), an epoxy resin, or a thermoplastic resin such as polyimide, or a resin impregnated into core materials such as glass fiber, glass cloth and glass fabric together with inorganic filler, prepregs, Ajinomoto build-up film (ABF), FR-4, bismaleimide triazine (BT), a photoimageable dielectric (PID) resin, a copper clad laminate (CCL), a glass or ceramic based insulating material, or the like.

The pattern, via, plane, strip, line, and electrical connection structure disclosed herein may include a metal material (e.g., a conductive material, such as copper (Cu), aluminum (Al), silver (Ag), tin (Sn), gold (Au), nickel (Ni), lead (Pb), titanium (Ti), an alloy of copper (Cu), aluminum (Al), silver (Ag), tin (Sn), gold (Au), nickel (Ni), lead (Pb), or titanium (Ti), or the like), and may be formed according by plating methods such as a chemical vapor deposition (CVD) process, a physical vapor deposition (PVD) process, a sputtering process, a subtractive process, an additive process, a semi-additive process (SAP), a modified semi-additive process (MSAP), and or the like, but is not limited to such materials and methods.

Referring to FIG. 10B, chip antenna modules 100*i* each including a patch antenna pattern may be respectively disposed adjacent to a center of sides of the electronic device 700*i*, which has a polygonal shape, on a set substrate 600*i* of the electronic device 700*i*. A communications module 610*i* and a baseband circuit 620*i* may also be arranged on the set substrate 600*i*. The chip antenna modules 100*i* may be electrically connected to the communications module 610*i* and/or the baseband circuit 620*i* through a coaxial cable 630*i*.

RF signals disclosed herein may have a format according to Wi-Fi (IEEE 802.11 family, etc.), WiMAX (IEEE 802.16 family, etc.), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols designated later thereto, but are not limited to such formats.

According to embodiments disclosed herein, a chip antenna module may improve antenna performance (e.g., gain, bandwidth, directivity, a transmission/reception rate, etc.) or may be easily miniaturized while enabling transmission/reception of signals in a plurality of different frequency bands.

The communications modules 610*h* and 610*i* in FIGS. 10A and 10B that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module, comprising:

a first dielectric layer;

a first feed via extending through the first dielectric layer;

a second feed via extending through the first dielectric layer;

a first patch antenna pattern disposed on an upper surface of the first dielectric layer, electrically connected to the first feed via, and having a through-hole;

a second patch antenna pattern disposed above the first patch antenna pattern and electrically connected to the second feed via; and a second dielectric layer and a third dielectric layer, respectively located vertically between the first patch antenna pattern and the second patch antenna pattern, and having different dielectric constants that form a first dielectric constant boundary surface between the first and second patch antenna patterns, wherein the second feed via extends through the through-hole, the second dielectric layer and the third dielectric layer, from the first dielectric layer, into connection with the second patch antenna pattern.

2. The chip antenna module according to claim 1, wherein the second dielectric layer is disposed below the third dielectric layer, and wherein a dielectric constant of the second dielectric layer is less than a dielectric constant of the third dielectric layer and a dielectric constant of the first dielectric layer.

3. The chip antenna module according to claim 2, further comprising a fourth dielectric layer disposed above the second patch antenna pattern, wherein a dielectric constant of a region corresponding to the fourth dielectric layer, among regions overlapping the second patch antenna pattern, is less than the dielectric constant of the third dielectric layer.

4. The chip antenna module according to claim 3, further comprising a fifth dielectric layer disposed above the fourth dielectric layer, wherein a thickness of the fourth dielectric layer is less than a thickness of the second dielectric layer.

5. The chip antenna module according to claim 1, further comprising fourth and fifth dielectric layers respectively located above the second patch antenna pattern, and having different dielectric constants that form a second dielectric constant boundary surface above the second patch antenna pattern.

6. The chip antenna module according to claim 5, further comprising a coupling patch pattern disposed on an upper surface of the fifth dielectric layer, wherein the fourth dielectric layer is disposed below the fifth dielectric layer, and wherein a dielectric constant of the fourth dielectric layer is less than a dielectric constant of the fifth dielectric layer and a dielectric constant of an uppermost positioned one of the second and third dielectric layers.

7. The chip antenna module according to claim 5, wherein a dielectric constant of an uppermost positioned one of the second and third dielectric layers is less than a dielectric constant of lowermost positioned one of the second and third dielectric layers, and wherein a dielectric constant of a lowermost positioned one of the fourth and fifth dielectric layers is greater than a dielectric constant of an uppermost positioned one of the fourth and fifth dielectric layers, and is greater than the dielectric constant of the uppermost positioned one of the second and third dielectric layers.

8. The chip antenna module according to claim 1, further comprising:

a fifth dielectric layer disposed above the second patch antenna pattern; and a coupling patch pattern disposed on an upper surface of the fifth dielectric layer.

9. The chip antenna module according to claim 8, wherein the coupling patch pattern has a hole.

10. The chip antenna module according to claim 1, wherein the second dielectric layer comprises a polymer, and wherein the third dielectric layer comprises a ceramic.

11. The chip antenna module according to claim 1, further comprising shielding vias electrically connected to the first patch antenna pattern, extending through the first dielectric layer, and surrounding the second feed via.

12. The chip antenna module according to claim 11, wherein a size of the second patch antenna pattern is smaller than a size of the first patch antenna pattern, and wherein a portion of the first feed via is disposed to not overlap the second patch antenna pattern.

13. The chip antenna module according to claim 1, further comprising a solder layer disposed on a lower surface of the first dielectric layer.

14. The chip antenna module according to claim 1, further comprising pads disposed on a lower surface of the first dielectric layer along a peripheral portion of the first dielectric layer.

15. A portable electronic device comprising the chip antenna module of claim 1.

16. A chip antenna module, comprising:

a first dielectric layer;

a first feed via extending through the first dielectric layer;

a second feed via extending through the first dielectric layer;

a first patch antenna pattern disposed on an upper surface of the first dielectric layer, electrically connected to the first feed via, and having a through-hole through which the second feed via passes;

a second patch antenna pattern disposed above the first patch antenna pattern and electrically connected to the second feed via;

a second dielectric layer and a third dielectric layer, respectively located vertically between the first patch antenna pattern and the second patch antenna pattern, and having different dielectric constants that form a first dielectric constant boundary surface between the first and second patch antenna patterns; and a fourth dielectric layer and a fifth dielectric layer, respectively located above the second patch antenna pattern, and having different dielectric constants that form a second dielectric constant boundary surface above the second patch antenna pattern.

17. The chip antenna module according to claim 16, further comprising shielding vias electrically connected to the first patch antenna pattern, extending through the first dielectric layer, and surrounding the second feed via.

18. The chip antenna module according to claim 17, wherein a size of the second patch antenna pattern is smaller than a size of the first patch antenna pattern, and wherein a portion of the first feed via is disposed to not overlap the second patch antenna pattern.

19. The chip antenna module according to claim 16, further comprising a coupling patch pattern disposed on an upper surface of the fifth dielectric layer.

20. The chip antenna module according to claim 19, wherein a size of the coupling patch pattern is smaller than a size of the second patch antenna pattern.

21. The chip antenna module according to claim 19, wherein the coupling patch pattern has a hole.

22. The chip antenna module according to claim 16, further comprising a coupling patch pattern disposed on an upper surface of the fifth dielectric layer, wherein the fourth dielectric layer is disposed below the fifth dielectric layer, and wherein a dielectric constant of the fourth dielectric layer is less than a dielectric constant of the fifth dielectric layer and a dielectric constant of the first dielectric layer.

23. The chip antenna module according to claim 16, further comprising a solder layer disposed on a lower surface of the first dielectric layer.

24. The chip antenna module according to claim 16, further comprising pads disposed on the first dielectric layer along a peripheral portion of the first dielectric layer.

25. A portable electronic device comprising the chip antenna module of claim 16.

26. A method of manufacturing a chip antenna module, comprising:

disposing a first surface of a second dielectric layer on a first surface of a third dielectric layer;

disposing a second patch antenna pattern on a second surface of the third dielectric layer, opposite the first surface of the third dielectric layer;

disposing a first patch antenna pattern on a first surface of a first dielectric layer; forming a first feed via extending through the first dielectric layer;

electrically connecting the first feed via to the first patch antenna pattern;

disposing a second surface of the second dielectric layer, opposite the first surface of the second dielectric layer, on the first surface of the first dielectric layer;

forming a second feed via extending through the first dielectric layer, a through-hole in the first patch antenna pattern, the second dielectric layer, and the third dielectric layer; and electrically connecting the second feed via to the second patch antenna pattern, wherein a dielectric constant of the second dielectric layer is different from a dielectric constant of the third dielectric layer.

27. The method of claim 26, further comprising:

disposing a first surface of a fourth dielectric layer on the second surface of the third dielectric layer; and disposing a first surface of a fifth dielectric layer on a second surface of the fourth dielectric layer, opposite the first surface of the fourth dielectric layer, wherein a dielectric constant of the fourth dielectric layer is different from a dielectric constant of the fifth dielectric layer.

28. The method of claim 27, further comprising disposing a coupling patch pattern on a second surface of the fifth dielectric layer, opposite the first surface of the fifth dielectric layer.

29. The method of claim 26, further comprising disposing a solder layer on a second surface of a first dielectric layer, opposite the first surface of the first dielectric layer.

* * * * *